US009669953B2

(12) United States Patent
Luo

(10) Patent No.: US 9,669,953 B2
(45) Date of Patent: Jun. 6, 2017

(54) PACKAGING MACHINE

(75) Inventor: Bangyi Luo, Hangzhou (CN)

(73) Assignee: HANGZHOU YOUNGSUN INTELLIGENT EQUIPMENT CO., LTD., Hangzhou, Zhejiang (CN)

( * ) Notice: Subject to any disclaimer, the term of this patent is extended or adjusted under 35 U.S.C. 154(b) by 392 days.

(21) Appl. No.: 14/358,684

(22) PCT Filed: Dec. 30, 2011

(86) PCT No.: PCT/CN2011/084962
§ 371 (c)(1),
(2), (4) Date: May 15, 2014

(87) PCT Pub. No.: WO2013/091262
PCT Pub. Date: Jun. 27, 2013

(65) Prior Publication Data

US 2014/0298760 A1 Oct. 9, 2014

(30) Foreign Application Priority Data

Dec. 22, 2011 (CN) ..... 2011 1 0436156

(51) Int. Cl.

| | |
|---|---|
| ***B65B 13/00*** | (2006.01) |
| ***B65B 13/06*** | (2006.01) |
| ***B65B 13/22*** | (2006.01) |
| ***B65B 13/32*** | (2006.01) |
| ***B65B 61/06*** | (2006.01) |

(52) U.S. Cl.
CPC ..... *B65B 13/00* (2013.01); *B65B 13/06* (2013.01); *B65B 13/22* (2013.01); *B65B 13/32* (2013.01); *B65B 61/06* (2013.01)

(58) Field of Classification Search
CPC ..... B65B 13/00
USPC ..... 53/64, 589, 389.1, 389.4; 100/4, 26, 29, 100/32, 33 PB, 25; 226/118.4
See application file for complete search history.

(56) References Cited

U.S. PATENT DOCUMENTS 3,916,779 A * 11/1975 Gutjahr ..... B65B 13/18 100/26
4,155,799 A * 5/1979 Matsushita ..... B65B 13/22 100/33 PB
4,691,498 A * 9/1987 Stamm ..... B65B 13/22 100/32

(Continued)

*Primary Examiner* — Thanh Truong
*Assistant Examiner* — Dariush Seif
(74) *Attorney, Agent, or Firm* — Han IP Corporation; Andy M. Han

(57) ABSTRACT

A packaging machine comprises a vertical mounting plate and a horizontal mounting plate fixed at an upper part of the vertical mounting plate. The horizontal mounting plate comprises a fixed frame that encloses an article binding workstation from left, right and above. The vertical mounting plate and the fixed frame are mounted on a packaging machine frame. The packaging machine also comprises a tape spool. A packaging machine core and a belt pre-feeding device are mounted on the horizontal mounting plate. The packaging machine core comprises a belt feeding and retreating and belt tensioning device. The belt feeding and retreating and belt tensioning device comprises a belt feeding and retreating mechanism and a belt tensioning mechanism. The packaging machine provides improvement in packaging quality, overall packaging efficiency and operation reliability.

9 Claims, 18 Drawing Sheets

(56) References Cited

U.S. PATENT DOCUMENTS 4,845,928 A * 7/1989 Sakaki ..... B65B 13/184 100/33 PB
4,885,901 A * 12/1989 Sakaki ..... B65B 13/184 53/389.4
5,083,412 A * 1/1992 Sakaki ..... B65B 13/18 100/2
5,146,847 A * 9/1992 Lyon ..... B65B 13/22 100/2
5,379,576 A * 1/1995 Koyama ..... B65B 13/22 100/26
5,560,187 A * 10/1996 Nagashima ..... B65B 13/187 100/26
5,778,643 A * 7/1998 Tacchini ..... B65B 13/22 53/582
5,809,873 A * 9/1998 Chak ..... B65B 13/22 100/26
6,038,967 A * 3/2000 Chak ..... B65B 13/22 100/2
6,041,581 A * 3/2000 Huber ..... B65B 13/22 100/26
6,141,946 A * 11/2000 Chin-Chang ..... B65B 13/184 100/26
6,415,712 B1 * 7/2002 Helland ..... B65B 13/22 100/26
6,463,848 B1 * 10/2002 Haberstroh ..... B65B 13/04 100/26
6,467,243 B1 * 10/2002 Su ..... B65B 13/22 100/29
6,530,194 B2 * 3/2003 Shibazaki ..... B65B 13/32 100/29
6,622,619 B1 * 9/2003 Liu ..... B65B 13/184 100/26
6,668,516 B2 * 12/2003 Sakaki ..... B65B 13/02 100/26
6,715,408 B1 * 4/2004 Rossi ..... B65B 13/22 100/29
6,766,624 B2 * 7/2004 Shibazaki ..... B65B 13/32 100/26
6,786,027 B2 * 9/2004 Oda ..... B65B 13/32 100/32
6,915,624 B2 * 7/2005 Shibazaki ..... B65B 13/32 53/389.2
6,928,787 B2 * 8/2005 Shibazaki ..... B65B 13/22 100/26
6,968,779 B2 * 11/2005 Doyle ..... B65B 13/06 100/2
6,981,353 B2 * 1/2006 Haberstroh ..... B65B 13/04 100/26
7,165,379 B1 * 1/2007 Lai ..... B65B 13/22 100/26
7,377,212 B1 * 5/2008 Wang ..... B65B 13/06 100/25
7,380,495 B1 * 6/2008 Wang ..... B65B 13/22 100/29
8,146,212 B2 * 4/2012 Nelson ..... B65D 63/06 24/20 R
8,607,695 B2 * 12/2013 Schwede ..... B65B 13/185 100/26
8,931,404 B2 * 1/2015 Lai ..... B65B 13/06 100/26
8,931,405 B2 * 1/2015 Lai ..... B65B 13/06 100/26
2002/0100259 A1 * 8/2002 Haberstroh ..... B65B 13/04 53/589
2002/0144489 A1 * 10/2002 Hoshino ..... B65B 13/06 53/589
2003/0159409 A1 * 8/2003 Oda ..... B65B 13/32 53/589
2004/0040266 A1 * 3/2004 Shibazaki ..... B65B 13/32 53/589
2004/0060259 A1 * 4/2004 Shibazaki ..... B65B 13/18 53/399
2004/0060267 A1 * 4/2004 Shibazaki ..... B65B 13/22 53/589
2004/0255552 A1 * 12/2004 Haberstroh ..... B65B 13/04 53/64
2004/0255562 A1 * 12/2004 Haberstroh ..... B65B 13/06 53/589
2005/0061164 A1 * 3/2005 Bobren ..... B65B 13/18 100/26
2013/0014654 A1 * 1/2013 Lai ..... B65B 13/22 100/32
2016/0001910 A1 * 1/2016 Luo ..... B65B 13/22 100/29
2016/0090201 A1 * 3/2016 Luo ..... B65B 13/32 100/25

* cited by examiner

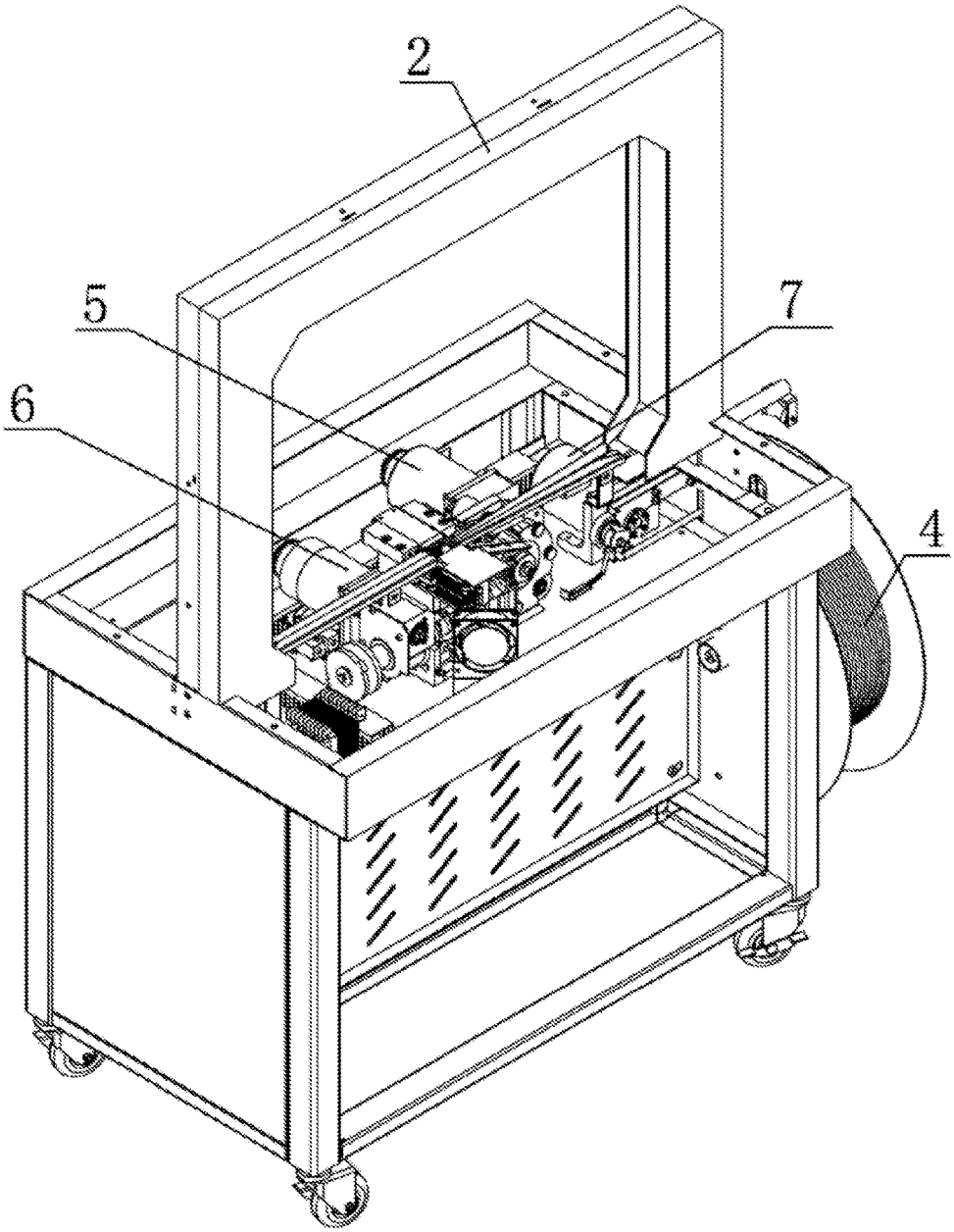
Figla 2-33
2-39
2-21
2-22
2-320
2-38
2-23
2-31
2-34
2-23
2-32
2-35
2-36

1-4
1-31
1-32
1-33
1-41
1-42

1-34
1-36
1-23
1-31
1-43
1-32
1-33

1-2
1-43
1-31
1-23
1-32
1-33

2-37

PACKAGING MACHINE

CROSS REFERENCE TO RELATED PATENT APPLICATIONS

The present disclosure is the U.S. national phase application of International application number PCT/CN2011/084962, filed on 30 Dec. 2011, which claims the priority benefit of China Patent Application No. 201110436156.0, filed on 22 Dec. 2011. The above-identified applications are hereby incorporated by reference in their entirety.

TECHNICAL FIELD

The present disclosure relates to a packaging machine.

BACKGROUND

A packaging machine is typically a device for strapping articles by packing belts. The packaging machine generally includes a machine core device for hot sticking and shearing packing belts, a frame mounting for winding binders by packing belts. The packaging machine is provided with a packing belt tensioning roller set, a belt feeding roller set and a belt pre-feeding roller set before the machine core. The whole packaging process includes steps such as belt feeding, belt retreating, tensioning, hot sticking and shearing. Generally both belt feeding and belt retreating are realized by their own roller set. A roller set generally consists of a drive wheel and a driven wheel which can engage to and disengage from the drive wheel. Previously, a mechanism for manipulating the driven wheel of a belt feeding and retreating roller set to engage to and disengage from the drive wheel is complex in components, heavy in weight, easy in terms of causing over-vibration in the process of belt feeding and retreating, thus causing belt feeding and retreating unstably and affecting the packaging and strapping effect. In a belt tensioning roller set, it is difficult to pre-adjust the pressure between the drive wheel and the driven wheel. The belt tensioning mechanism may apply either too much or insufficient tensioning force on different packing belts.

In general, the structure of the conventional packaging machine needs improvement for matching the packaging efficiency, operation reliability and packaging quality.

SUMMARY

The present disclosure aims at solving the aforementioned technical problem by providing a new packaging machine capable of improving packaging quality, packaging efficiency and operation reliability. For this purpose, the present disclosure adopts such a technical scheme as that described below. The packaging machine is provided with a vertical mounting plate at the lower half part, and a horizontal mounting plate fixed at the upper part of the vertical mounting plate. The horizontal mounting plate is provided with a fixed frame at the upper half part. The fixed frame encloses an article binding workstation from left, right and above. The vertical mounting plate and the fixed frame are mounted on a packaging machine frame. The packaging machine is also provided with a belt spool at the lower part. A packaging machine core and a belt pre-feeding device are mounted on the horizontal mounting plate. The packaging machine core is provided with a belt feeding and retreating and belt tensioning device. The belt feeding and retreating and belt tensioning device comprises a belt feeding and retreating mechanism and a belt tensioning mechanism.

The belt feeding and retreating mechanism comprises a belt feeding and retreating drive wheel and a belt feeding and retreating driven wheel. The belt feeding and retreating driven wheel is sleeved on a belt feeding and retreating driven wheel axle. The belt feeding and retreating driven wheel axle is driven by a first eccentric mechanism. The belt feeding and retreating mechanism also comprises a first wrench rod and a swing drive mechanism of the first wrench rod. When driven by the first wrench rod, the first eccentric mechanism can rotate. The swing drive mechanism of the first wrench rod moves under the control of a cam. The swing drive mechanism of the first wrench rod is provided with an insert position for insertion of the first wrench rod. After actively inserting into the insert position, the first wrench rod, driven by a device constituting the insert position, can swing up and down. The insert position consists of a plurality of pins arranged above and below the first wrench rod, respectively.

The belt tensioning mechanism includes a belt tensioning drive wheel and a belt tensioning driven wheel. The belt tensioning driven wheel is sleeved on a belt tensioning driven wheel axle. The belt tensioning driven wheel axle is driven by a second eccentric mechanism. The belt tensioning mechanism also comprises a second wrench rod swingable and a swing drive mechanism of the second wrench rod. When driven by the second wrench rod, the second eccentric mechanism can rotate. The swing drive mechanism of the second wrench rod moves under the control of a cam.

The swing drive mechanism of the second wrench rod includes a connecting rod and a second swing rod arranged vertically. The second swing rod is connected with a first knuckle bearing which is actively sleeved on the connecting rod. The second wrench rod is connected to a second knuckle bearing which is actively sleeved and supported on the connecting rod. The second knuckle bearing is positioned under the first knuckle bearing. One end of the connecting rod is in threaded connection with an adjusting nut. The first knuckle bearing is provided with a first pressure spring at the upper part. Between the first knuckle bearing and the second knuckle bearing a second pressure spring is provided. Both the first pressure spring and the second pressure spring are sleeved outside the connecting rod. The first swing rod is provided with a rolling element matched with the cam.

The belt feeding and retreating drive wheel and the belt tensioning drive wheel are driven by a belt feeding and retreating and belt tensioning drive motor. The first wrench rod, the second wrench rod and the belt feeding and retreating and belt tensioning drive motor are positioned on the same side of the packaging machine core. The belt feeding and retreating drive wheel, the belt feeding and retreating driven wheel, the belt tensioning drive wheel and the belt tensioning driven wheel are positioned on the other side of the packaging machine core.

On the basis of adoption of the technical scheme mentioned above, the present disclosure also can further adopt such a technical scheme as described below.

In the present disclosure, the fixed frame is provided with a packing belt track which encloses an article binding workstation from left, right and above. The inner side of the fixed frame is provided with a packing belt outlet along the packing belt track. The fixed frame is internally provided with a fixed track wall outboard and a movable track wall inboard which consists of a plurality of rotatable single blades. A packing belt carrying track is formed between the fixed track wall and the movable track wall. On the basis of feed direction of packing belts, the upstream end of a single blade downstream laps outside of the downstream end of an adjacent single blade upstream. The rotatable single blade is provided with a return spring which enables the single blade to restore and reconstitute the movable track wall after it is opened by packing belts.

In the present disclosure, the first eccentric mechanism includes a first connecting plate and a first eccentric shaft. The belt feeding and retreating driven wheel axle and the first eccentric shaft are positioned on the two sides of the first connecting plate. The belt feeding and retreating driven wheel axle is parallel to the first eccentric shaft, but not on the same axis. The first wrench rod is connected with the first eccentric shaft.

The second eccentric mechanism includes a second connecting plate and a second eccentric shaft. The belt tensioning driven wheel axle and the second eccentric shaft are positioned on the two sides of the second connecting plate. The belt tensioning driven wheel axle is parallel to the second eccentric shaft, but not on the same axis. The second wrench rod is connected with the second eccentric shaft.

In the present disclosure, the swing drive mechanism of the first wrench rod includes a first lifting rod and a first swing rod. The lower end of the first lifting rod is articulated with the first swing rod. The insert position is located on a unit installed on the first lifting rod. The first swing rod is provided with a rolling element matched with a cam controlling the swing drive mechanism of the first wrench rod.

Both the first wrench rod and the first swing rod are respectively connected with a return spring.

In the present disclosure, the belt feeding and retreating and belt tensioning drive motor is provided with a reduction gear set. The belt tensioning drive wheel is arranged on the reduction output shaft of the reduction gear set. The input end gear of the reduction gear set is arranged on the power-output shaft of the motor. The motor is also provided with a belt drive mechanism. The drive wheel of the belt drive mechanism is arranged on the power-output shaft of the motor. The belt feeding and retreating drive wheel is connected with the driven wheel of the belt drive mechanism.

In the present disclosure, the movable single blade is outwards cocked at its upstream end corner of the opened side. The installation side of the movable single blade is flexed and forms the bottom of packing belt track.

The movable single blade is connected to a hinge, the return spring thereof is arranged in the hinge. The hinge is installed on the fixed frame or the fixed track wall.

The fixed track wall is fixedly connected to the fixed frame.

The fixed frame consists of a frame body and a frame cover plate. The lower part of the fixed frame is provided with a lower left packing belt track and a lower right packing belt track which are fixedly installed. Both the lower left packing belt track and the lower right packing belt track gradually become narrow along the belt moving direction downstream.

In the present disclosure, the packaging machine is provided with a packaging machine core work process control apparatus which includes a rotatable main shaft. The main shaft is connected via a reducing mechanism to a drive motor. The drive motor and the belt feeding and retreating and belt tensioning drive motor are positioned at the same side of the packaging machine core. The main shaft is provided with a plurality of cams pivoting on the main shaft. The cams include a plurality of cams controlling hot sticking and cutting, cams controlling the swing drive mechanism of the first wrench rod, and cams controlling the swing drive mechanism of the second wrench rod. The work process control apparatus is also provided with a first inductor and a second inductor along the axial direction of the main shaft. Output signal from both the inductors is used for controlling operation of motors in the belt feeding and retreating and belt tensioning device as well as the drive motor. The main shaft is also provided with two turnplates pivoting on the main shaft; each of the turnplates is provided with a baffle matched with the corresponding inductor.

Both the cams and the turnplates in the work process control apparatus are arranged at both sides of the connecting location between the main shaft and the reducing mechanism. The reducing mechanism is a turbine worm or a reduction gear set.

One of the two turnplates is provided with a first baffle and a second baffle which are matched with the first inductor. The starting baffle signal from the first baffle and the first inductor is used for rotation of the belt feeding and retreating and belt tensioning drive motor toward belt retreating direction. The packaging machine is also provided with a plurality of time relays, and has a first shutoff opportunity for rotation of the belt feeding and retreating and belt tensioning drive motor toward belt retreating direction under the control of the time relays. The drive motor of the work process control apparatus has a second shutoff opportunity after the first shutoff opportunity. The second shutoff opportunity is controlled by the time relays. The drive motor of the work process control apparatus has a third startup opportunity after the second shutoff opportunity, the third startup opportunity is controlled by the time relays. The stand-by time (between the second shutoff opportunity and the third startup opportunity) of the drive motor of the work process control apparatus is used for hot sticking by the packaging machine core. The second baffle is matched with the first inductor after the third startup opportunity. The starting baffle signal sent from the second baffle to the first inductor is used for rotation of the belt feeding and retreating and belt tensioning drive motor toward belt feeding direction. The rotation time of the belt feeding and retreating and belt tensioning drive motor toward belt feeding direction is controlled by the time relays and an in-position inductor. The other one of the two turnplates is provided with a third baffle. The third baffle is matched with the second inductor after ceasing rotation of the belt feeding and retreating and belt tensioning drive motor toward belt feeding direction. The output signal from the second inductor is used for controlling flyback action of the drive motor of the work process control apparatus for the next cyclic operation.

In the present disclosure, the belt pre-feeding device includes a belt pre-feeding drive wheel, a belt pre-feeding driven wheel, and a belt pre-feeding drive wheel drive motor. The belt pre-feeding drive wheel, the belt pre-feeding driven wheel, the belt feeding and retreating drive wheel, the belt feeding and retreating driven wheel, the belt tensioning drive wheel and the belt tensioning driven wheel are positioned at the same side of the vertical mounting plate. The drive motor of the belt pre-feeding device, the drive motor of the work process control apparatus and the belt feeding and retreating and belt tensioning drive motor are at the same side of the vertical mounting plate.

The packaging machine is provided with a packing belt warehouse on the belt feeding path after the belt pre-feeding device. The belt warehouse is used for storage of packing belts. The belt pre-feeding device is provided with a control device which includes a balance stop lever positioned on the bottom of the belt warehouse and used for supporting packing belts in the belt warehouse. The balance stop lever can be swingable. The control device is provided with an inductor for sensing the amplitude of swing of the balance stop lever. Output signal from the inductor is used for controlling operation of the drive motor of the belt pre-feeding device. The control device is also provided with a spring which is connected with the balance stop lever. The moment of force applied by the spring to the balance stop lever is opposite to that applied by the packing belt supporting the balance stop lever to the balance stop lever. The spring is arranged at the other side of the vertical mounting plate which is separated by the spring and the belt warehouse. The spring is a tension spring.

In the present disclosure, the belt pre-feeding device is also provided with a brake mechanism for belt spool packing belts output. Under the action of drawing force applied by the belt pre-feeding device to the packing belts, the brake mechanism acts toward the direction of brake relief. The belt pre-feeding mechanism is also provided with a return spring of the brake mechanism. The return spring enables the brake mechanism to act toward the direction of braking. The brake mechanism includes a brake rod, a brake band and a brake disc which are articulated. One end of the brake band is installed fixedly, the other end is connected with the brake rod via bypassing the brake disc. One end of the return spring is installed fixedly, while the other end is connected with the brake rod. The brake rod is provided with a packing belts guide wheel. The drawing force applied by the belt pre-feeding device to the packing belts is transferred to the brake mechanism via the packing belts guide wheel. The belt pre-feeding device is also provided with an operating rod and a return spring. The operating rod is connected with the driven wheel. The return spring is used for restoring the belt pre-feeding device to its normal position after the driven wheel deviates from the drive wheel under the operation of the operating rod.

The packaging machine core is internally provided with a hot sticking slide plate mechanism which includes a top slide, a bottom slide, a fixed part provided with a sliding chute, and a hot sticking slide plate swing arm positioned below the bottom slide. The sliding chute includes a top layer guide slot for sliding of the top slide, and a bottom layer guide slot for sliding of the bottom slide. The fixed part provided with the sliding chute includes a left back-up block and a right back-up block which are fixed on a packaging machine core rack. The slide plate mechanism is also provided with a bottom slide chair on which the bottom slide is arranged. The bottom slide chair is provided with a vertical sliding chute connected with the hot sticking slide plate swing arm. The rear of the top slide is connected with a unit which leans against the rear end of the bottom slide. The unit which leans against the rear end of the bottom slide is connected with a tension spring which aids the unit to adjoin the bottom slide. The top slide is matched with a left cutter, a middle cutter and a right cutter which are in a cutter mechanism. The hot sticking slide plate swing arm can swing at the side in which the packaging machine core is provided with a belt feeding and retreating and belt tensioning drive motor.

The packaging machine core is internally provided with a cutter mechanism which includes a left cutter, a middle cutter and a right cutter, wherein the belt cutter mechanism is also provided with a guide part arranged on the packaging machine core rack. The guide part is internally provided with a vertical lifting guide hole for the left cutter, a vertical lifting guide hole for the middle cutter, and a vertical lifting guide hole for the right cutter. The belt cutter mechanism is also provided with a left cutter guide pillar, a middle cutter guide pillar, and a right cutter guide pillar. The left cutter guide pillar, the middle cutter guide pillar and the right cutter guide pillar are respectively positioned in and slidingly and guidingly matched with the lifting guide hole for the left cutter, the lifting guide hole for the middle cutter and the lifting guide hole for the right cutter. The left cutter, the middle cutter and the right cutter are respectively arranged on the top of the left cutter guide pillar, the middle cutter guide pillar and the right cutter guide pillar. The left cutter guide pillar, the middle cutter guide pillar and the right cutter guide pillar are respectively provided with a mounting hole open downward. The left cutter guide pillar, the middle cutter guide pillar and the right cutter guide pillar are respectively mounted on a lifting drive plunger which is inserted into the mounting hole. Between the lifting drive plunger and the mounting hole is provided with a pressure spring. The guide part is a part of the packaging machine core rack.

The packaging machine core is internally provided with a hot sticking mechanism which includes a hot sticking head, and a hot sticking head swing arm below the hot sticking head. The hot sticking mechanism is also provided with a hot sticking head seat slidable along the direction perpendicular to packing belts for hot sticking. The hot sticking head is mounted on the top of the hot sticking head seat. The hot sticking mechanism is also provided with a guide mechanism for sliding of the hot sticking head seat. The hot sticking head swing arm is connected with the hot sticking head seat. The hot sticking head seat is provided with a vertical sliding chute connected with the hot sticking head swing arm. The hot sticking head swing arm is provided with a unit in slip connection with the vertical sliding chute. The guide mechanism includes a second left back-up block and a second right back-up block which are fixed on the packaging machine core rack. The second left back-up block and the second right back-up block are respectively provided with a guide slot for sliding of the hot sticking head seat. Both sides of the hot sticking head seat are provided with a side track slidingly matched with the guide slot. Between the lower end of the hot sticking head seat and the hot sticking head swing arm is connected with a tension spring. The hot sticking head swing arm, the first wrench rod and the second wrench rod are at the same side of the packaging machine core.

The packaging machine core is internally provided with a packaging machine core rack which is divided into three separate parts: a first rack positioned in the middle, used for installing the packaging machine and related to hot sticking and belt cutting. A second rack used for installing the drive motor and the reducing mechanism of the work process control apparatus. And a third rack used for installing the belt feeding and retreating and belt tensioning device. The packaging machine core rack is mounted on the horizontal mounting plate. The first rack positioned in the middle, the second rack and the third rack are respectively positioned at both sides of the first rack.

The side at which the first rack is close to the third rack is provided with a first wallboard. The side at which the first rack is close to the second rack is provided with a connecting plate. Between the first wallboard and the connecting plate is connected with a beam.

The side at which the second rack is close to the first rack is provided with a second wallboard which is connected with the connecting plate by bolts. The side (of the second rack) at which the second wallboard deviates from the first rack is provided with a bedplate for installing the drive motor and the reducing mechanism of the work process control apparatus. The bedplate includes a bedplate inner chamber which is used for setting the reducing mechanism. The outer wall of the bedplate inner chamber is provided with an installation interface for installing the drive motor of the work process control apparatus.

Due to adoption of the technical scheme mentioned in the present disclosure, the packaging machine reasonably configures each functional device and is simple to control, thus improving packaging quality, overall packaging efficiency and operation reliability.

In the present disclosure, driven by the swing drive mechanism, the first wrench rod of the belt feeding and retreating and belt tensioning device can swing and is in pluggable connection with a device constituting the insert position. Therefore, the first wrench rod can conduct right and left compensatory activities simultaneously along the insert position relative to the device constituting the insert position. In this way, the swing drive mechanism is unnecessarily to be provided with a knuckle bearing with a larger weight, thus reducing the total weight of the mechanism for manipulating driven wheels, reducing the vibration in the process of belt feeding and retreating, enabling the belt feeding and retreating actions stable, and improving the packaging effect. Meanwhile, the first wrench rod and the swing drive mechanism can be selectively connected with a return spring, which provides the belt feeding and retreating mechanism with better adaptability and selectivity. The swing drive mechanism of the second wrench rod in the belt feeding and retreating and belt tensioning device is provided with two elastic elements. The elastic element above can control the belt tension (strapping tension), and conveniently pre-adjust the belt tension by adjusting the nut. The elastic element below plays a buffer action, controls the interval between the tensioning drive wheel and driven wheel, and improves the working sensitivity of tensioning belts.

BRIEF DESCRIPTION OF THE DRAWINGS

FIG. 1*a* is an overall schematic diagram of the present disclosure, showing the internal structure of the packaging machine as a whole.

DETAILED DESCRIPTION OF THE PREFERRED EMBODIMENTS

Figure 1:
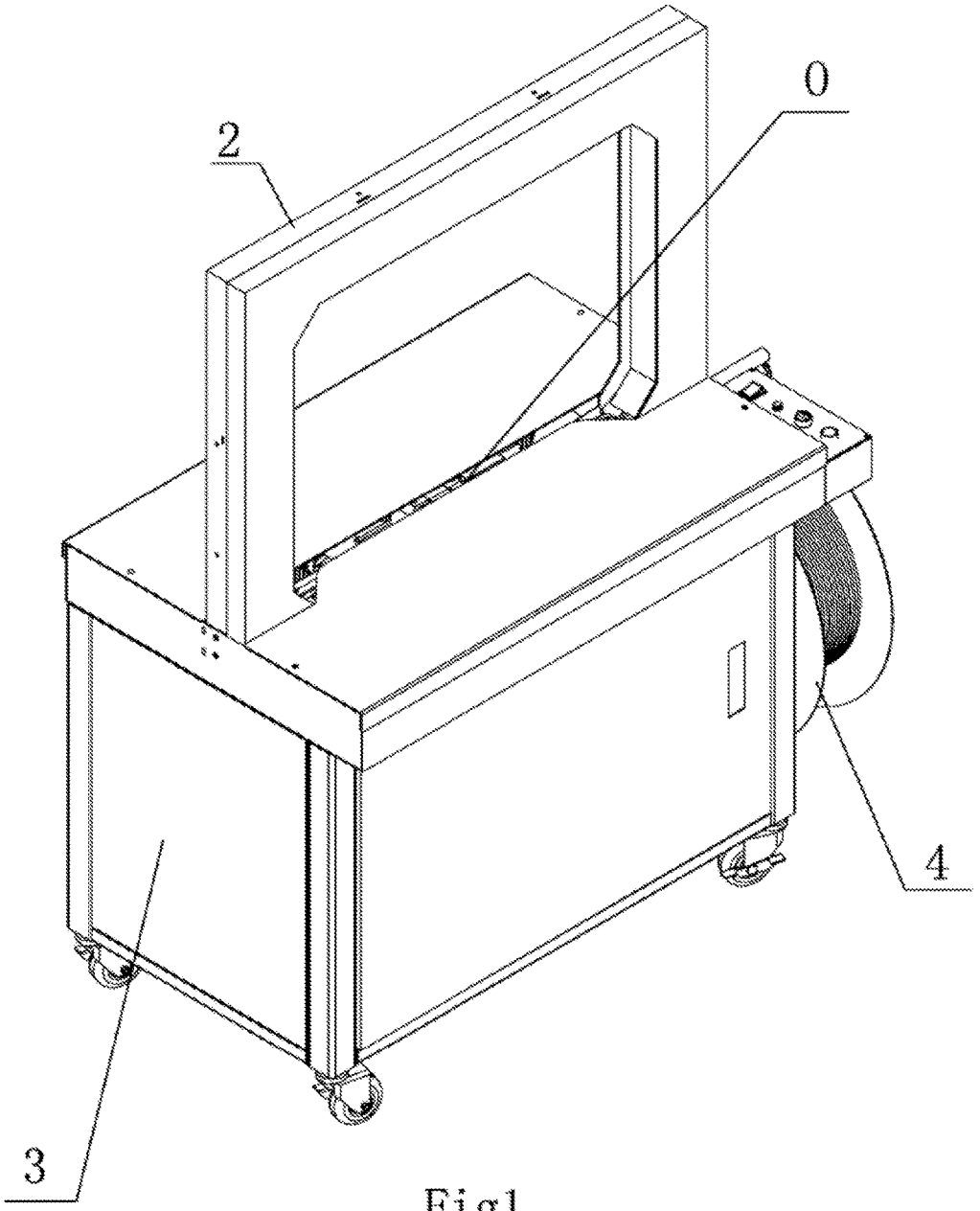
FIG. 1 is an overall schematic diagram of the present disclosure, showing the external shape of the packaging machine as a whole.
Figure 1B:
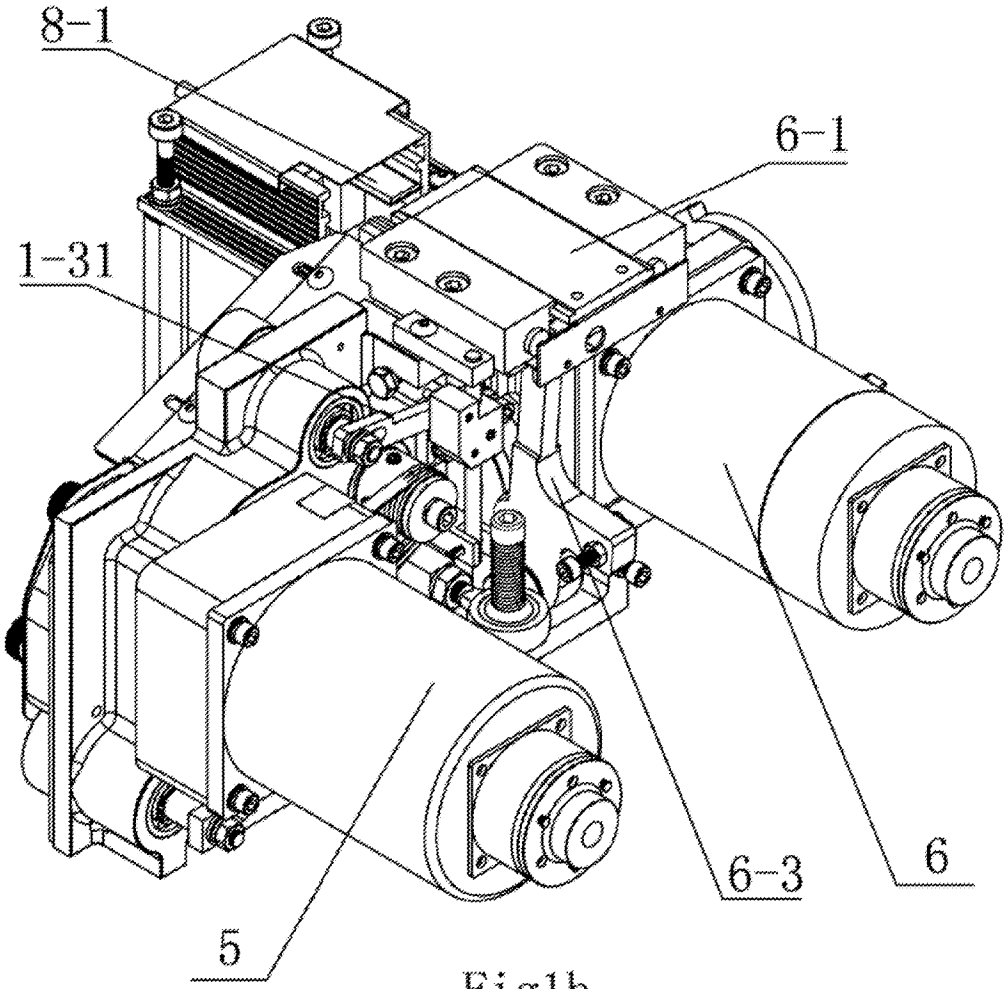
FIG. 1*b* is an overall schematic diagram of the structure of the packaging machine core in the present disclosure.
Figure 2:
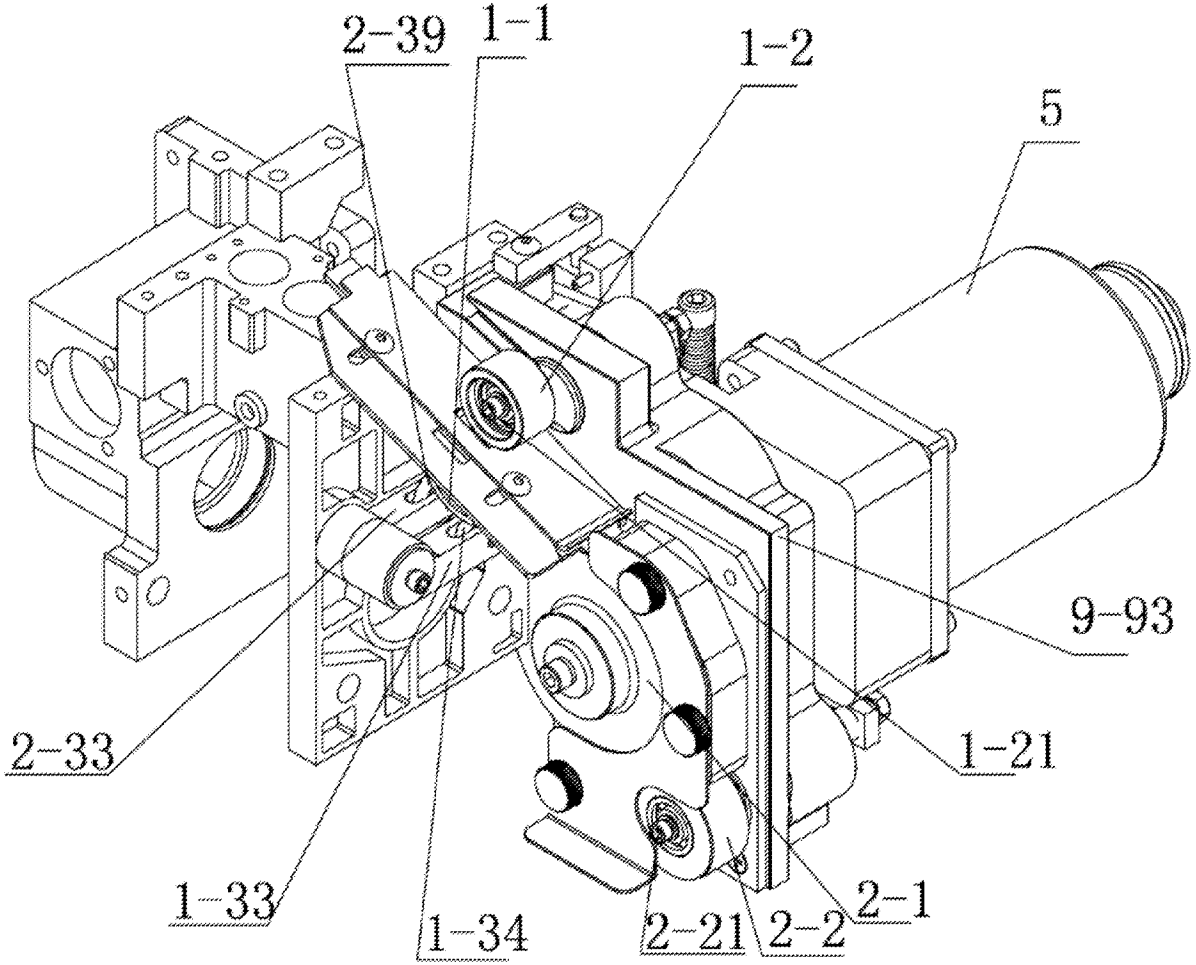
FIG. 2 is a schematic diagram of the embodiment in which the belt feeding and retreating and belt tensioning device provided by the present disclosure is applied to the machine core.
Figure 4:
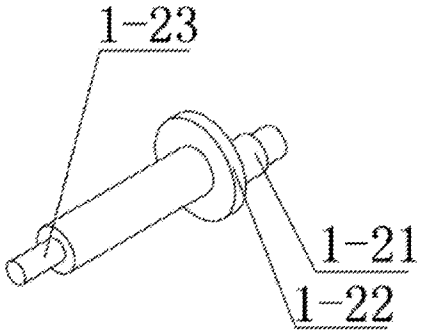
FIG. 4 is a schematic diagram of the driven wheel axle and the eccentric mechanism in the belt feeding and retreating and belt tensioning device shown in FIG. 2 and FIG. 3.
Figure 3:
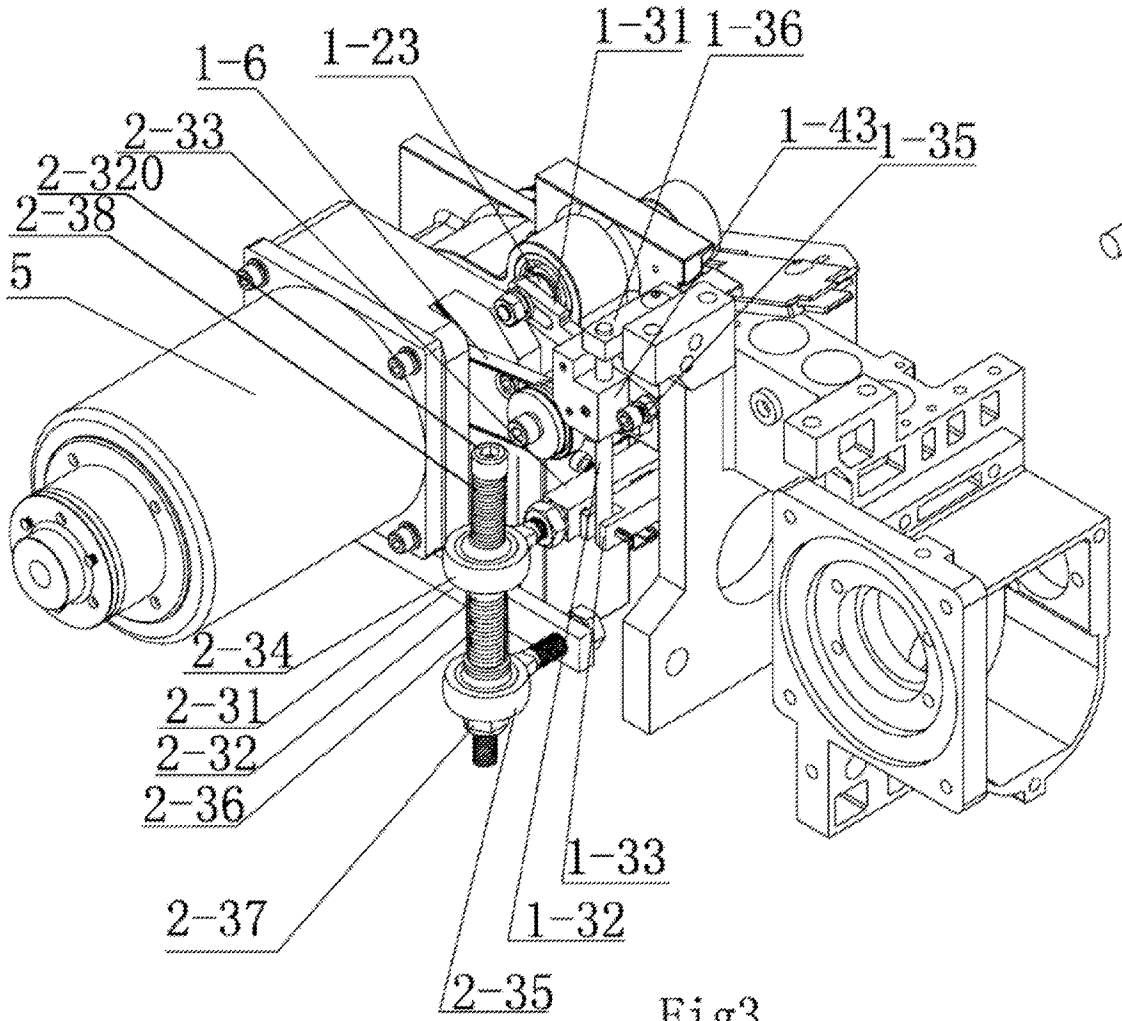
FIG. 3 is a schematic diagram of the embodiment in which the belt feeding and retreating and belt tensioning device provided by the present disclosure is applied to the machine core in the other direction.
Figures 5, 6, 7, 8:
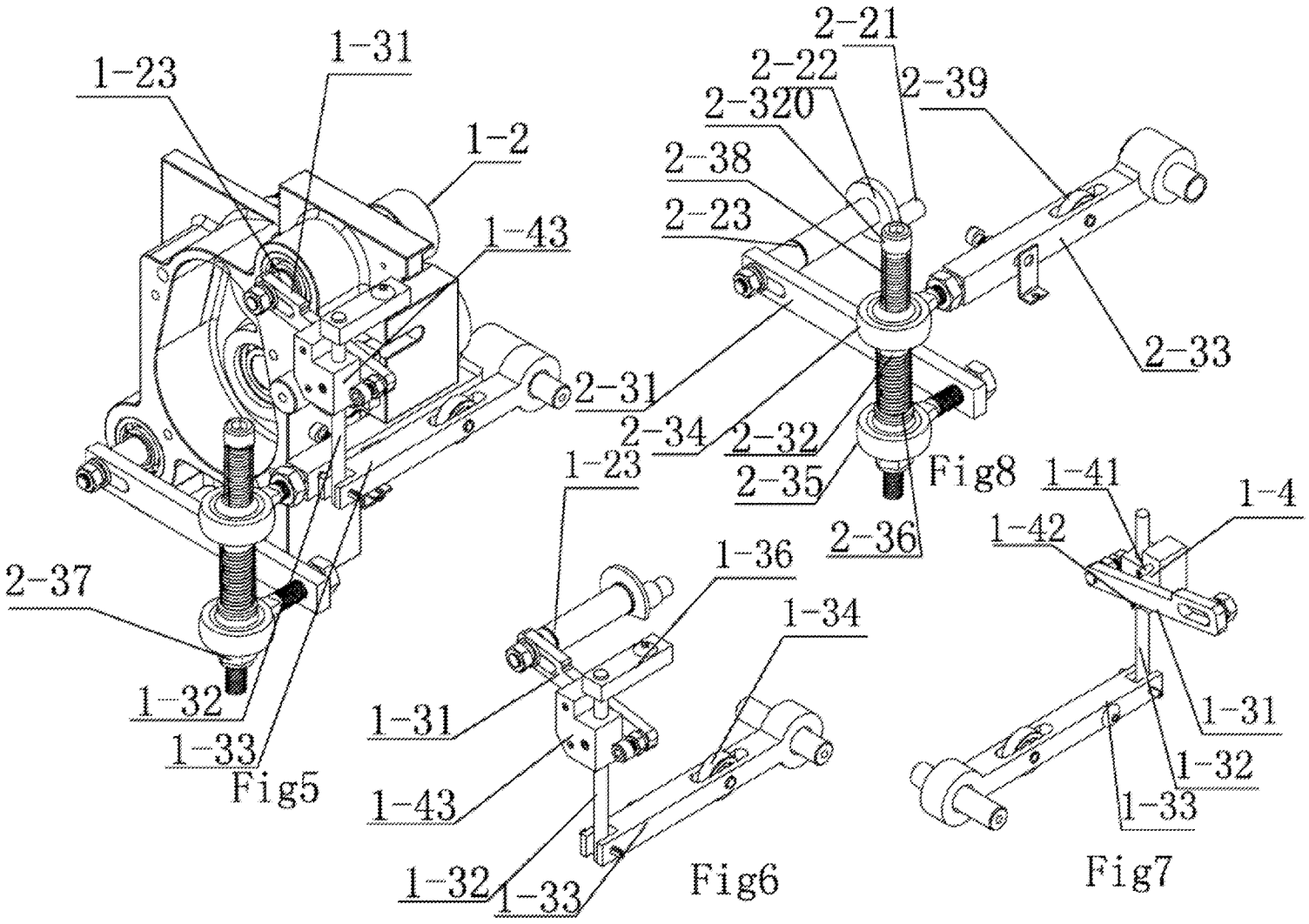
FIG. 5 is a structure diagram related to the belt feeding and retreating and belt tensioning device in the packaging machine core.
FIG. 6 is a schematic diagram of the belt feeding and removing mechanism in the belt feeding and retreating and belt tensioning device shown in FIG. 2 and FIG. 3.
FIG. 7 is a schematic diagram of the belt feeding and removing mechanism in the belt feeding and retreating and belt tensioning device shown in the other direction in FIG. 2 and FIG. 3.
FIG. 8 is a schematic diagram of the belt tensioning mechanism in the belt feeding and retreating and belt tensioning device shown in FIG. 2 and FIG. 3.

Refer to the attached drawings, the packaging machine in the present disclosure is provided with a vertical mounting plate 1 at the lower half part, and a horizontal mounting plate 9 fixed at the upper part of the vertical mounting plate 1. The horizontal mounting plate 9 is provided with a fixed frame 2 at the upper half part. The fixed frame encloses an article binding workstation 0 from left, right and above. The vertical mounting plate 1 and the fixed frame 2 are mounted on a packaging machine frame 3. The packaging machine is also provided with a belt spool 4 at the lower part. A packaging machine core and a belt pre-feeding device are mounted on the horizontal mounting plate 9. The packaging machine core is provided with a belt feeding and retreating and belt tensioning device. The belt feeding and retreating and belt tensioning device comprises a belt feeding and retreating mechanism and a belt tensioning mechanism.

Refer to FIGS. 1-8. The belt feeding and retreating mechanism comprises a belt feeding and retreating drive wheel 1-1 and a belt feeding and retreating driven wheel 1-2. The belt feeding and retreating driven wheel 1-2 is sleeved on a belt feeding and retreating driven wheel axle 1-21. The belt feeding and retreating driven wheel axle 1-21 is driven by a first eccentric mechanism. The belt feeding and retreating mechanism also comprises a first wrench rod 1-31 and a swing drive mechanism of the first wrench rod 1-31. When driven by the first wrench rod, the first eccentric mechanism can rotate. The swing drive mechanism of the first wrench rod 1-31 moves under the control of a cam. The swing drive mechanism of the first wrench rod 1-31 is provided with an insert position 1-4 for insertion of the first wrench rod. After actively inserting into the insert position 1-4, the first wrench rod 1-31, driven by a device constituting the insert position, can swing up and down. The insert position consists of a plurality of pins 1-41 and 1-42 arranged above and below the first wrench rod 1-31, or a short slot consisting of other components, so that the first wrench rod 1-31 can be in pluggable connection with a device constituting the insert position. The first wrench rod can conduct right and left compensatory activities simultaneously along the insert position relative to the device constituting the insert position.

The belt tensioning mechanism includes a belt tensioning drive wheel 2-1 and a belt tensioning driven wheel 2-2. The belt tensioning driven wheel 2-2 is sleeved on a belt tensioning driven wheel axle 2-21. The belt tensioning driven wheel axle 2-21 is driven by a second eccentric mechanism. The belt tensioning mechanism also comprises a second wrench rod 2-31 swingable and a swing drive mechanism of the second wrench rod. When driven by the second wrench rod 2-31, the second eccentric mechanism can rotate. The swing drive mechanism of the second wrench rod moves under the control of the cam.

The swing drive mechanism of the second wrench rod includes a connecting rod 2-32 and a second swing rod 2-33 arranged vertically. The second swing rod 2-33 is connected with a first knuckle bearing 2-34 which is actively sleeved on the connecting rod 2-32. The second wrench rod 2-31 is connected to a second knuckle bearing 2-35 which is actively sleeved and supported on the connecting rod 2-32. The second knuckle bearing 2-35 is positioned under the first knuckle bearing 2-34. Between the second knuckle bearing 2-35 and the first knuckle bearing 2-34 is provided with a second pressure spring 2-36. The lower end of the connecting rod 2-32 is in threaded connection with an adjusting nut 2-37. The first knuckle bearing is provided with a first pressure spring 2-38 at the upper part. Between the first knuckle bearing 2-34 and the second knuckle bearing 2-35 a second pressure spring 2-36 is provided. Both the first pressure spring 2-38 and the second pressure spring 2-36 are sleeved outside the connecting rod 2-32. The second swing rod 2-33 is provided with a rolling element 2-39 matched with the cam. Numeral reference 2-320 in the attached drawing stands for the other end socket of the connecting rod. The pressure spring 2-38 is positioned between the upside of the first knuckle bearing and the end socket 2-320. In addition, it is permissible that the connecting rod 2-32 is reversed. In other words, the upper end of the connecting rod is in threaded connection with an adjusting nut 2-37, with the end socket 2-320 downward. In addition, the end socket can also be substituted by a nut or a spacer, etc.

The belt feeding and retreating drive wheel 1-1 and the belt tensioning drive wheel 2-1 are driven by a belt feeding and retreating and belt tensioning drive motor 5. The first wrench rod 1-31, the second wrench rod 2-31 and the drive motor 5 are positioned on the same side of the packaging machine core. The belt feeding and retreating drive wheel, the belt feeding and retreating driven wheel, the belt tensioning drive wheel and the belt tensioning driven wheel are positioned on the other side of the packaging machine core.

Both the first eccentric mechanism and the second eccentric mechanism adopt the same structure. Further description is provided below by taking the first eccentric mechanism as an example. The first eccentric mechanism includes a first connecting plate 1-22 and a first eccentric shaft 1-23. The belt feeding and retreating driven wheel axle 1-21 and the first eccentric shaft 1-23 are positioned on the two sides of the first connecting plate 1-22. The belt feeding and retreating driven wheel axle 1-21 is parallel to the first eccentric shaft 1-23, but not on the same axis. The first wrench rod 1-31 is connected with the first eccentric shaft 1-23.

The swing drive mechanism of the first wrench rod includes a first lifting rod and a first swing rod. The lower end of the first lifting rod is articulated with the first swing rod. The insert position is located on a block installed on the first lifting rod. The first swing rod is provided with a rolling element matched with a cam.

The swing drive mechanism of the first wrench rod includes a first lifting rod 1-32 and a first swing rod 1-33. The lower end of the first lifting rod 1-32 is articulated with the first swing rod 1-33. The insert position 1-4 is located on a unit 1-43 installed on the first lifting rod 1-32. A plurality of pins 1-41 and 1-42 are arranged on the unit 1-43. The first swing rod 1-33 is provided with a rolling element 1-34 matched with a cam controlling the swing drive mechanism of the first wrench rod. Numeral reference 1-36 in attached drawing stands for the lifting guide block in slip connection with the lifting rod.

Both the first wrench rod 1-31 and the first swing rod 1-33 are respectively connected with a return spring. Numeral reference 1-35 in attached drawing stands for the screw (on the first wrench rod 1-31) for connecting a tension spring.

In the present disclosure, the second swing rod 2-33 can be connected with a return spring.

Figure 9:
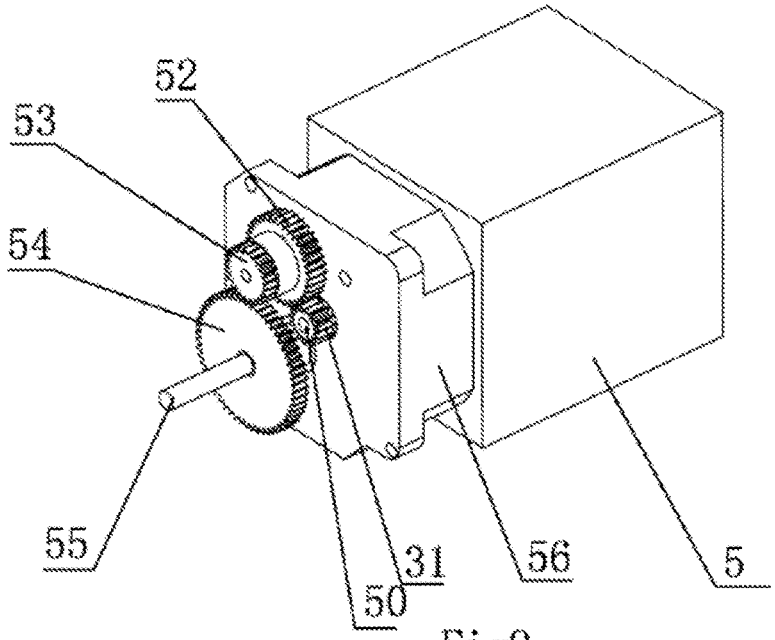
FIG. 9 is a schematic diagram of the power output structure of the driving motor in the belt feeding and retreating and belt tensioning device shown in FIG. 2 and FIG. 3.
Figure 10:
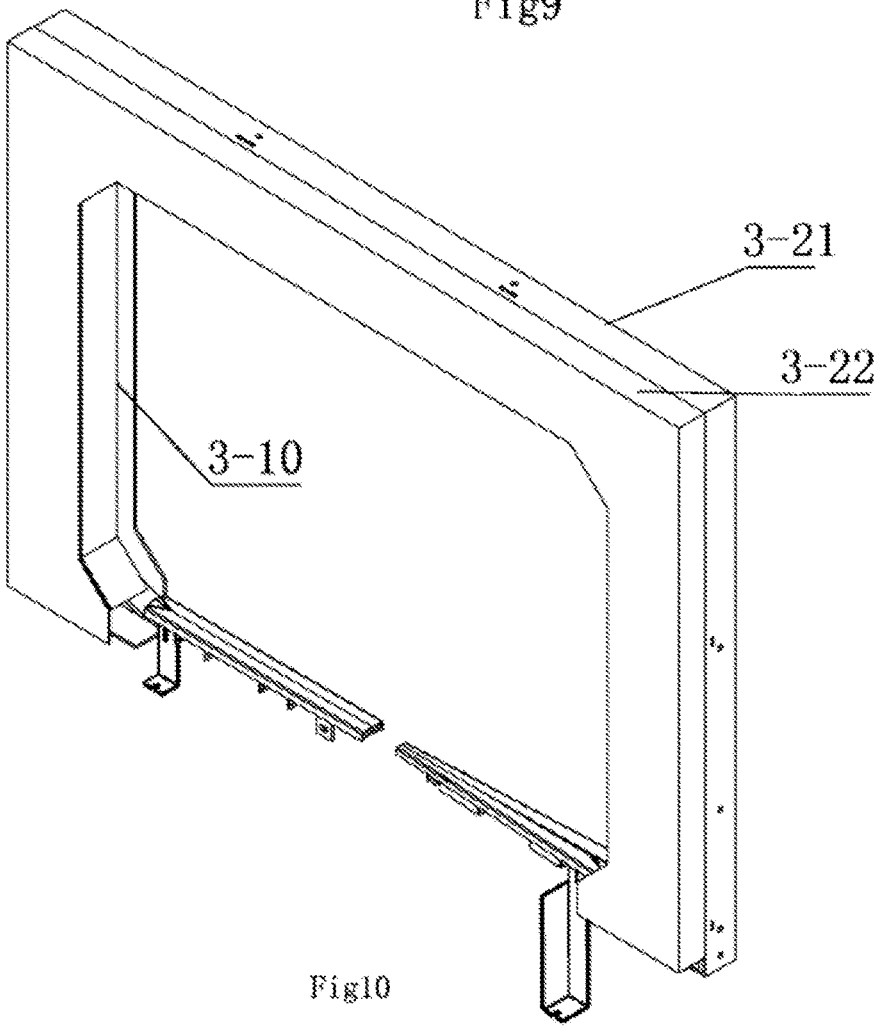
FIG. 10 is a schematic diagram of the fixed frame and its inner structure in the present disclosure.
Figure 12:
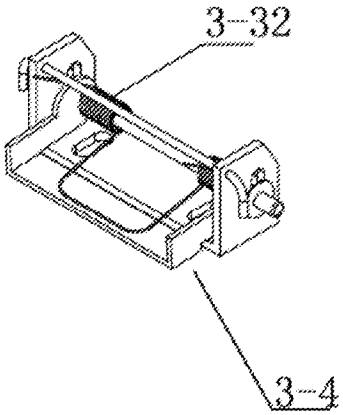
FIG. 12 is a schematic diagram of the hinge in the structure shown in FIG. 10.
Figure 11:
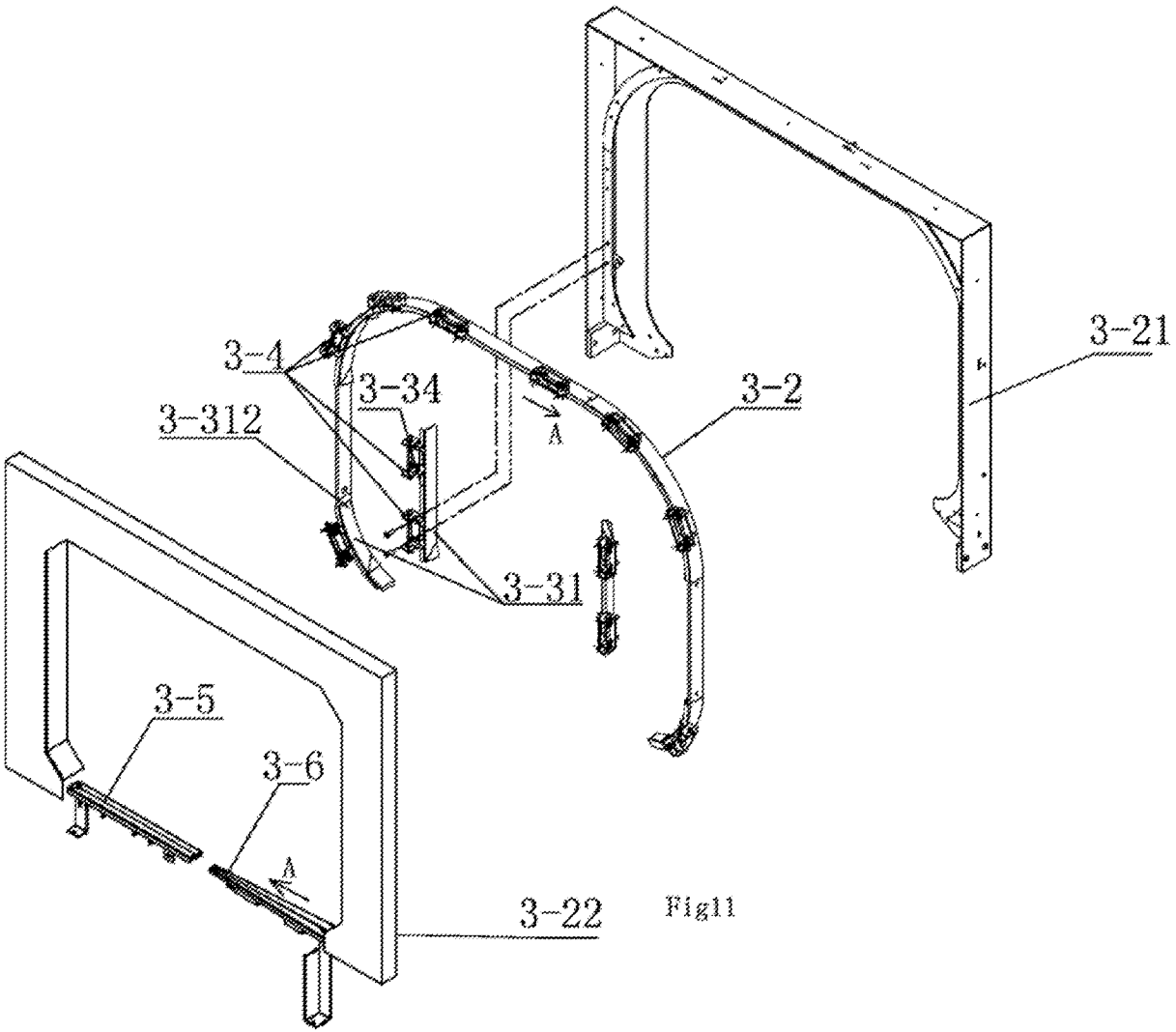
FIG. 11 is an explosive view of the structure shown in FIG. 10.
Figure 14:
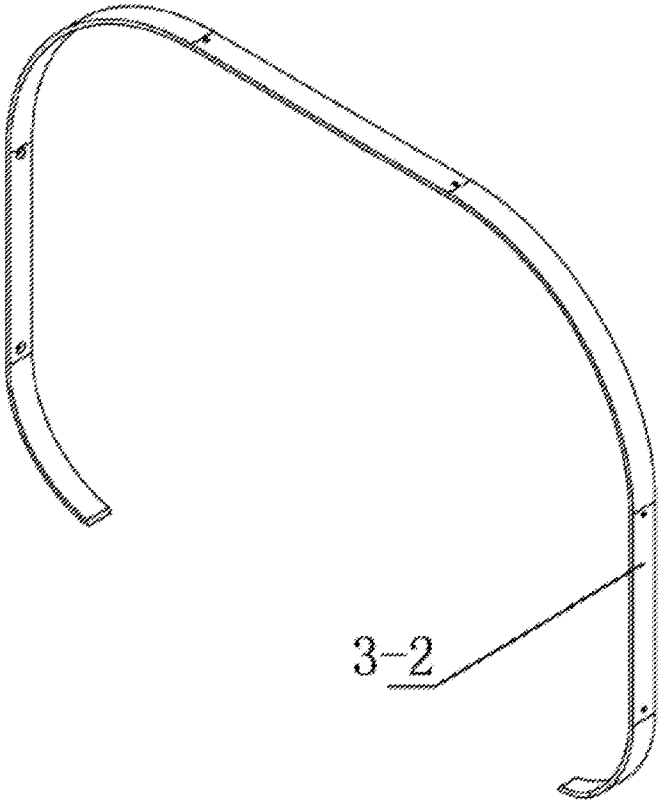
FIG. 14 is a schematic diagram of the fixed track wall in the structure shown in FIG. 10.
Figure 13:
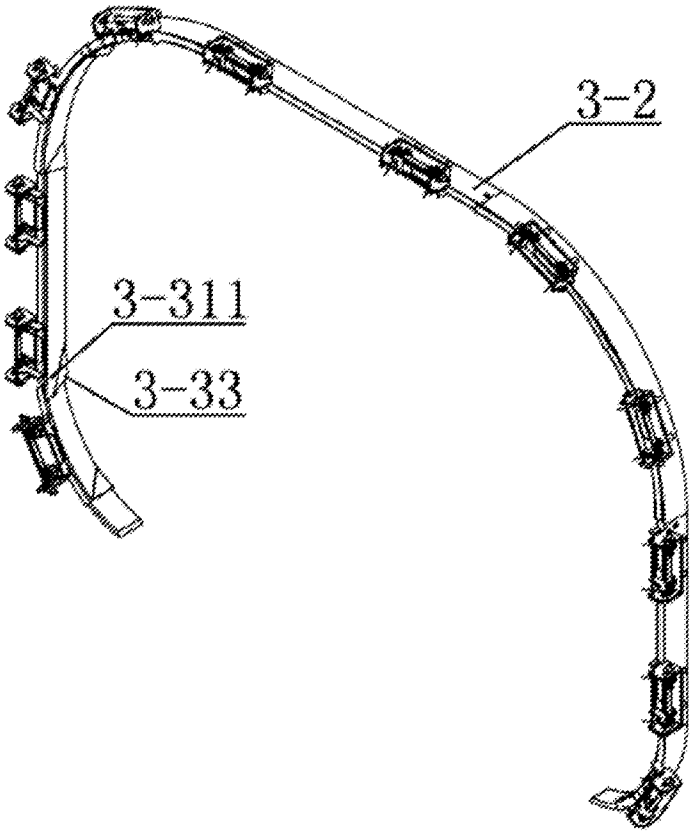
FIG. 13 is a schematic diagram of the fixed track wall and the movable track wall in the structure shown in FIG. 10.

Refer to FIG. 9, the belt feeding and retreating and belt tensioning drive motor is provided with a reduction gear set. The reduction gear set consists of an input end gear 51, a primary reduction gear 52, a transition gear 53 and a secondary reduction gear 54. The shaft 55 of the secondary reduction gear 54 is the reduction output shaft of the reduction gear set. The belt tensioning drive wheel 2-1 is arranged on the reduction output shaft 55 of the reduction gear set. The input end 51 gear of the reduction gear set is arranged on the power-output shaft 50 of the motor. The motor is also provided with a belt drive mechanism. The transmission belt in the belt drive mechanism is the belt 1-6.

The drive wheel of the belt drive mechanism is positioned in a case cover 56 and arranged on the power-output shaft of the motor. The belt feeding and retreating drive wheel is connected with the driven wheel of the belt drive mechanism. Based on different requirements for the belt feeding and retreating and belt tensioning, the belt feeding and retreating drive wheel adopts belt drive as its power source. The belt feeding and removing mechanism is set at such a distance from the motor 5 that the belt tensioning mechanism obtains power from the motor 5 directly by transmission of the reduction gear set. In this way, driven by the same motor, the speed of the belt feeding and retreating can be guaranteed, also the revolving speed of the belt tensioning drive wheel can be controlled by the gear reduction group, thus providing the packing belts with appropriate tensioning force.

Refer to FIGS. 1, 1*a* and 10-14. The fixed frame 2 is provided with a packing belt track which encloses an article binding workstation 0 from left, right and above. The inner side of the fixed frame is provided with a packing belt outlet 3-10 along the packing belt track. The fixed frame is internally provided with a fixed track wall 3-2 outboard and a movable track wall inboard which consists of a plurality of rotatable single blades 3-31. A packing belt carrying track is formed between the fixed track wall 3-2 and the movable track wall. On the basis of feed direction A of packing belts, the upstream end 3-311 of a single blade downstream laps outside of the downstream end 3-312 of an adjacent single blade upstream. The rotatable single blade 3-31 is provided with a return spring 3-32 which enables the single blade 3-31 to restore and reconstitute the movable track wall after it is opened by packing belts (the impact force applied by packing belts outward to the rotatable single blade when they are tensioned for strapping articles).

The movable single blade is outwards cocked at its upstream end corner 3-33 of the opened side, which contributes to more smooth motion of the packing belts when they are tensioned and strapped and break away from the packing belt track in sequence. The installation side 3-34 of the movable single blade is flexed and forms the bottom of packing belt track.

The movable single blade is connected to a hinge 3-4. The return spring 3-32 thereof is arranged in the hinge 3-4. The hinge 3-4 is installed on the fixed frame or the fixed track wall.

The fixed track wall 3-2 is fixedly connected to the fixed frame.

The fixed frame consists of a frame body 3-21 and a frame cover plate 3-22 connected to each other.

The lower part of the fixed frame is provided with a lower left packing belt track 3-5 and a lower right packing belt track 3-6 which are fixedly installed. Both the lower left packing belt track 3-5 and the lower right packing belt track 3-6 gradually become narrow along the belt moving direction A downstream, which makes machine core belt feeding accurate and stable. Between the lower left packing belt track 3-5 and the lower right packing belt track 3-6 is the packaging machine core which hot sticks and cuts off packing belts. On the machine core is provided with an article binding workstation 0.

Packing belts are input from the machine core to the lower left packing belt track 3-5, reeving clockwise, come out of the lower right packing belt track 3-6 and then enter the machine core part. The packing belt track in the fixed frame, the lower left packing belt track 3-5 and the lower right packing belt track 3-6 are connected to form a round. When the packaging machine is started for strapping articles, the packing belt takes a turn along the packing belt track, and then the packing belt is retreated and tensioned. Under the action of the tensioning force, the packing belts break through the movable single blade successively and break away from the fixed frame in sequence, thus strapping articles.

When packing belts are tensioned by the inside wall of the packing belt track of the above-mentioned structure, the movable track wall is opened in sequence along the belt moving direction instead of being totally opened at one go. Thus, packing belts break away from the packing belt track from front to back in sequence, free of mutual interference of packing belts, twist or off tracking, which contributes to improving packaging and strapping quality. Meanwhile, successive superposition direction of the movable single blade is along the belt moving direction, which guarantees more smooth of belt moving, and both the movable track and the wall thereof of the packing belts are formed by one kind of material, with no need for splicing by other materials.

Figure 15:
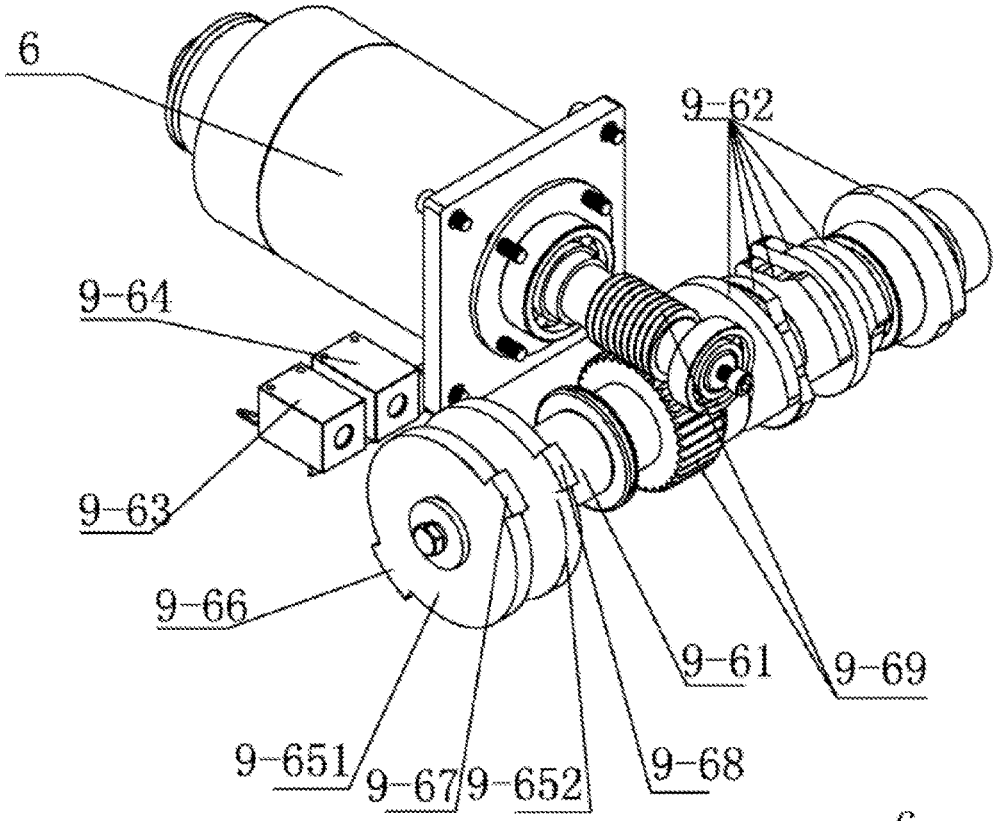
FIG. 15 is a three-dimensional schematic diagram of one embodiment of the work process control apparatus in the present disclosure in one direction.
Figure 16:
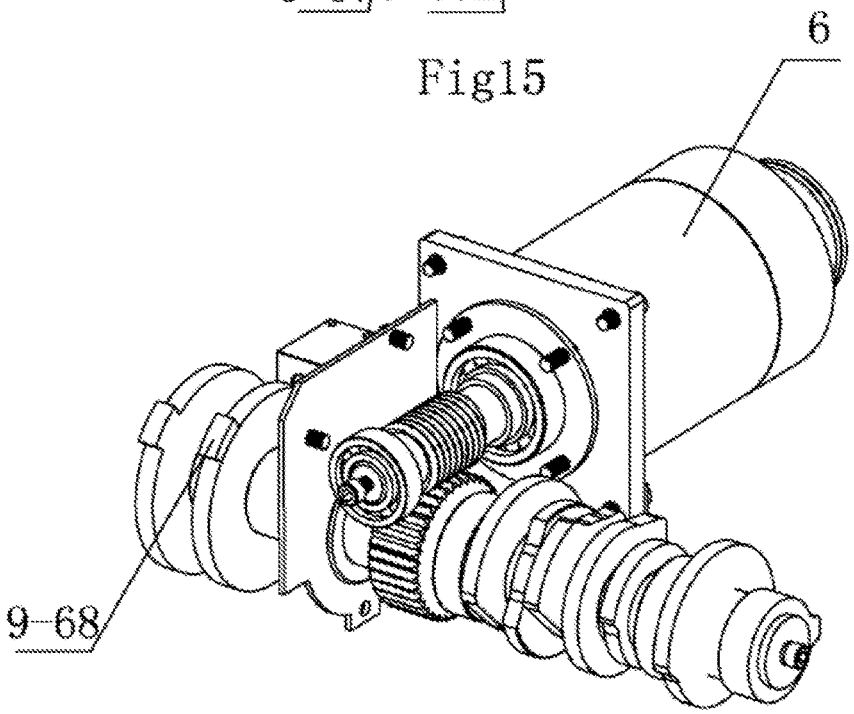
FIG. 16 is a three-dimensional schematic diagram of one embodiment of the work process control apparatus in the present disclosure in the other direction.

Refer to FIGS. 15 and 16. In the present disclosure, the packaging machine is provided with a packaging machine core work process control apparatus which includes a rotatable main shaft 9-61. The main shaft is connected via a reducing mechanism to a drive motor 6. The drive motor 6 and the drive motor 5 are positioned at the same side of the packaging machine core. The main shaft is provided with a plurality of cams 9-62 pivoting on the main shaft. The cams 9-62 include a plurality of cams controlling hot sticking and belt cutting, cams controlling the swing drive mechanism of the first wrench rod 1-31, and cams controlling the swing drive mechanism of the second wrench rod 2-31. The work process control apparatus is also provided with a first inductor 9-63 and a second inductor 9-64 along the axial direction of the main shaft 9-61. Output signal from both the inductors is used for controlling operation of the motor 5 in the belt feeding and retreating and belt tensioning device as well as the drive motor 6. The main shaft 9-61 is also provided with two turnplates 9-651 and 9-652 pivoting on the main shaft.

In the present disclosure, both the cams 9-62 and the turnplates 9-65 and 9-652 in the work process control apparatus are arranged at both sides of the connecting location between the main shaft 9-61 and the reducing mechanism. The reducing mechanism is a turbine worm 9-69 or a reduction gear set.

The turnplate 9-651 is provided with a first baffle 9-66 and a second baffle 9-67 which are matched with the first inductor 9-63. After the starting switch for packaging is pressed, the drive motor 6 starts working and the main shaft 9-61 starts rotating, the starting baffle signal from the first baffle 9-66 and the first inductor is used for rotation of the belt feeding and retreating and belt tensioning drive motor 5 toward belt retreating direction. The packaging machine is also provided with a plurality of time relays, and has a first shutoff opportunity for rotation of the belt feeding and retreating and belt tensioning drive motor toward belt retreating direction under the control of the time relays. The drive motor 6 continues working before rotation of the drive motor 5 toward belt retreating direction reaches the first shutoff opportunity. The first wrench rod 1-31 and the second wrench rod 2-31 are controlled to successively work by the swing drive mechanism control cam of the first wrench rod 1-31 and the swing drive mechanism control cam of the second wrench rod 2-31 respectively. The belt feeding and retreating and belt tensioning device conducts belt retreating and belt tensioning successively. After a belt is tensioned, the hot sticking mechanism is controlled by the hot sticking and belt cutting control cam for pushing out and cutting belts.

The drive motor 6 of the work process control apparatus has a second shutoff opportunity after the first shutoff opportunity, the second shutoff opportunity is controlled by the time relays. The drive motor of the work process control apparatus has a third startup opportunity after the second shutoff opportunity. The third startup opportunity is controlled by the time relays. The stand-by time (between the second shutoff opportunity and the third startup opportunity) of the drive motor of the work process control apparatus is used for hot sticking by the packaging machine core. The second baffle is matched with the first inductor after the third startup opportunity. The starting baffle signal sent from the second baffle to the first inductor is used for rotation of the belt feeding and retreating and belt tensioning drive motor 5 toward belt feeding direction. The rotation time of the belt feeding and retreating and belt tensioning drive motor 5 toward belt feeding direction is controlled by the time relays and the in-position inductor 6-8.

The turnplate 9-652 is provided with a third baffle 9-68. The third baffle 9-68 is matched with the second inductor 9-64 after ceasing rotation of the belt feeding and retreating and belt tensioning drive motor 5 toward belt feeding direction. The output signal from the second inductor 9-64 is used for controlling flyback action of the drive motor of the work process control apparatus for the next cyclic operation.

In the packaging machine of the above-mentioned structure, the packaging machine core, the control cam of the belt feeding and retreating and belt tensioning device, and the induction mechanism of the motor are integrated into a main shaft, while the control apparatus for the drive motor of the belt pre-feeding device is controlled by another control apparatus. In this way, the whole control system is divided more reasonably, more convenient for operation and control of the packaging machine.

Figure 17:
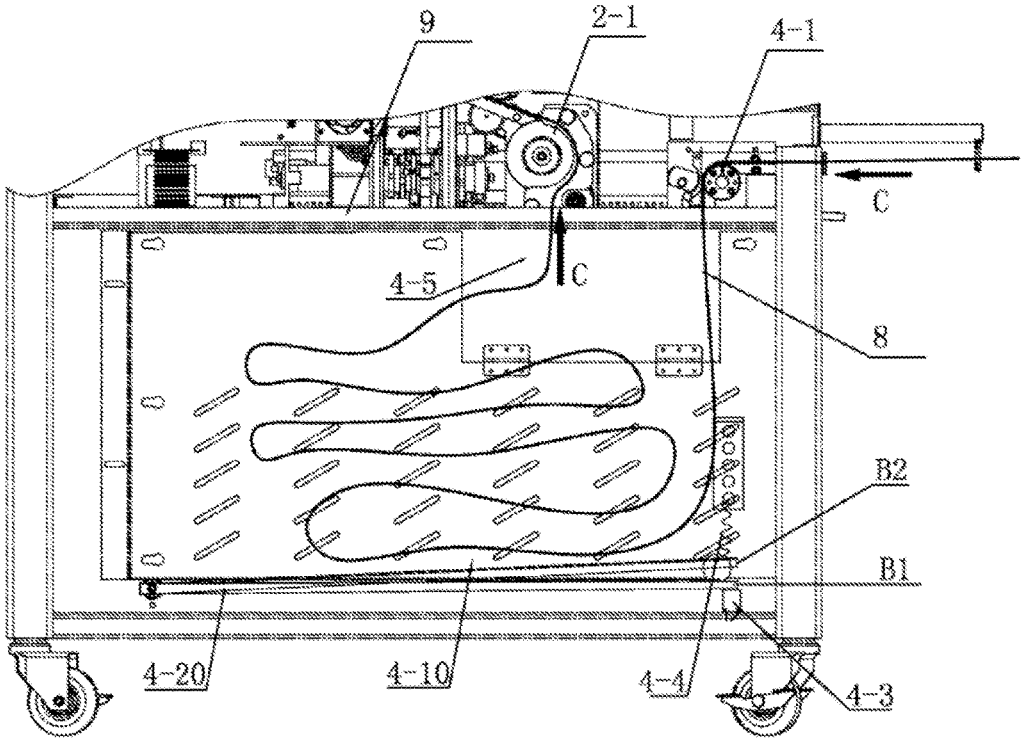
FIG. 17 is a schematic diagram of one embodiment of the control apparatus of the belt pre-feeding device in the present disclosure.
Figure 18:
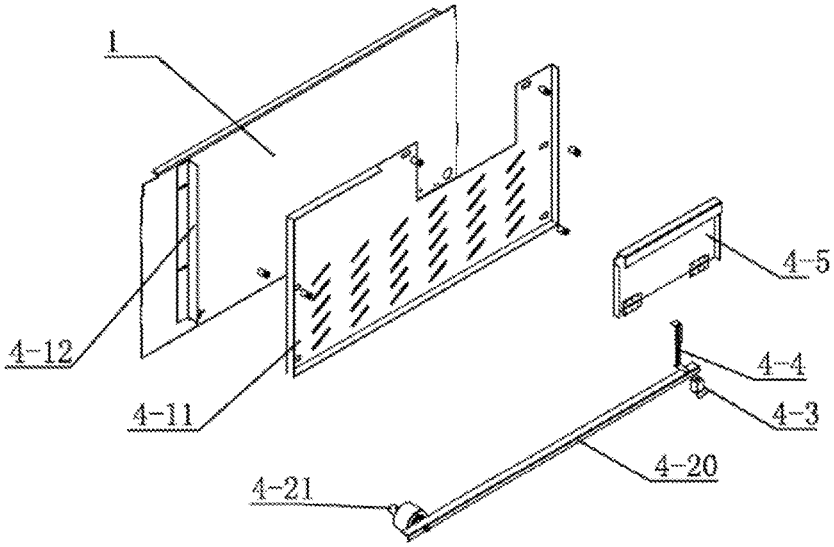
FIG. 18 is an explosive view of the structure shown in FIG. 17.
Figure 19:
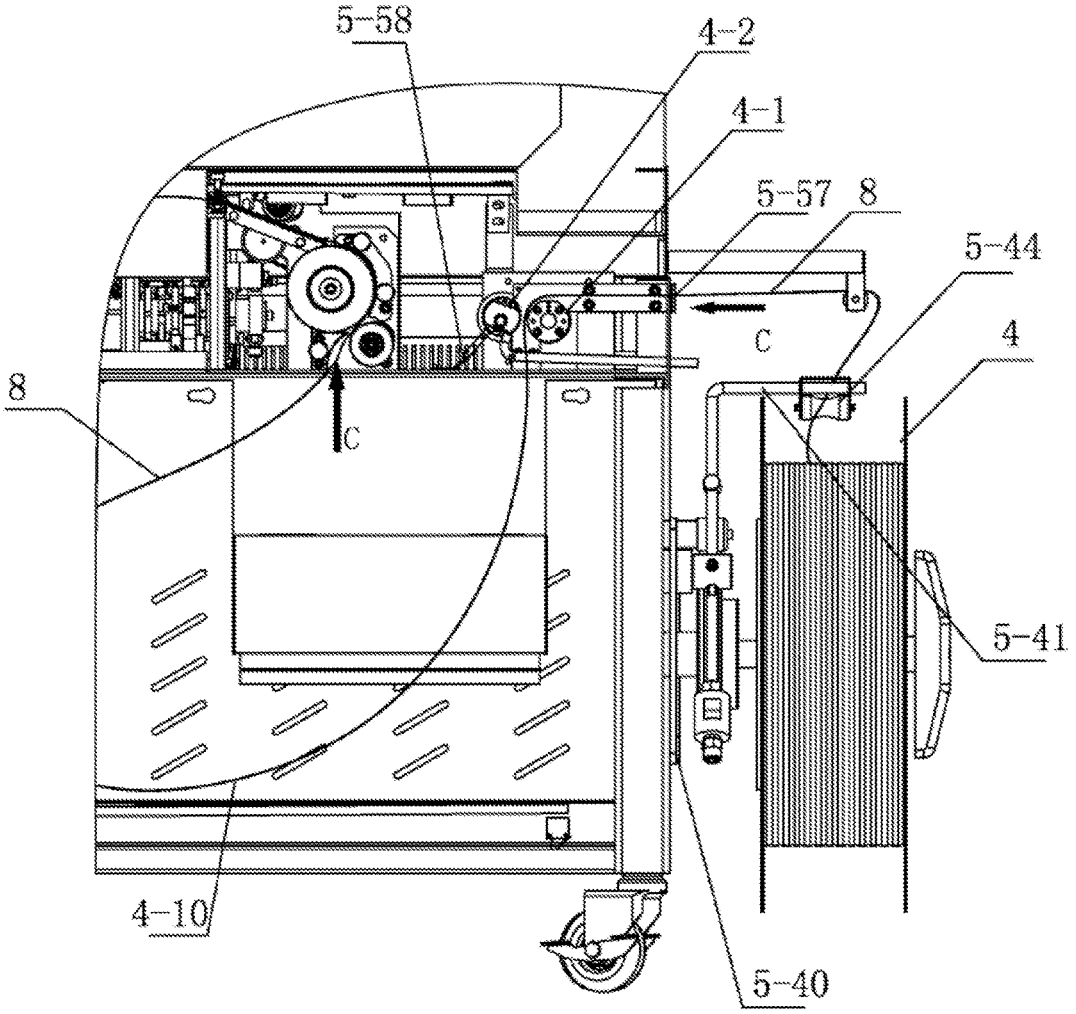
FIG. 19 is a schematic diagram of the brake mechanism for belt spool packing belts output and the related structure in the present disclosure.
Figure 20:
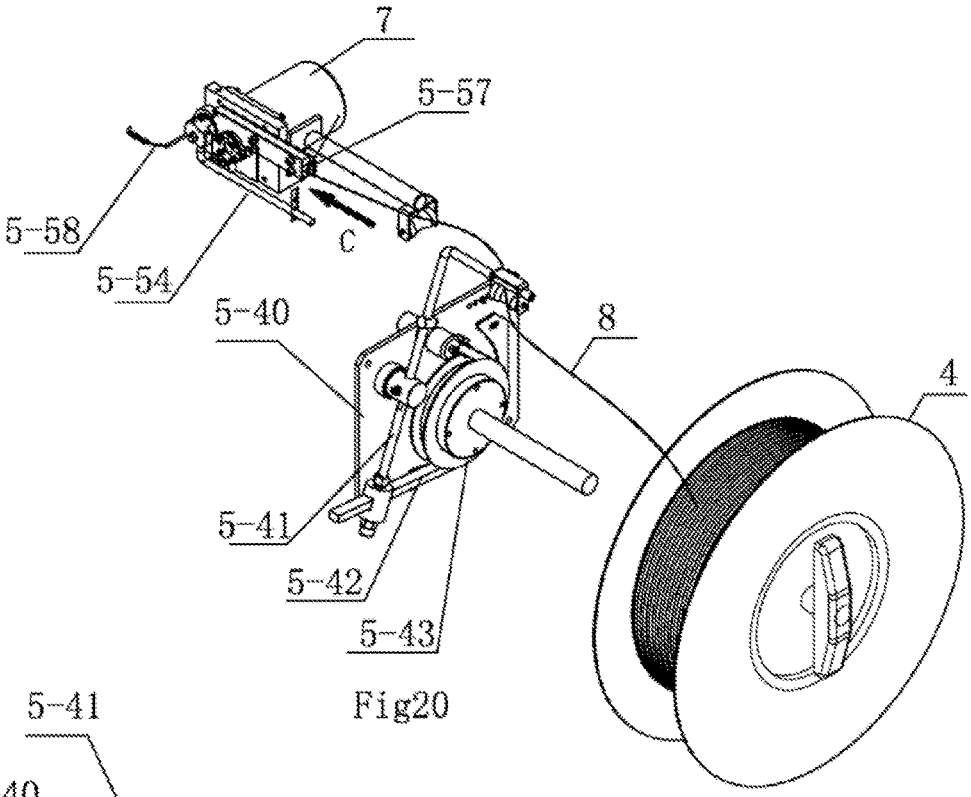
FIG. 20 is an explosive view of the structure of the brake mechanism for belt spool packing belts output shown in FIG. 19.
Figure 21:
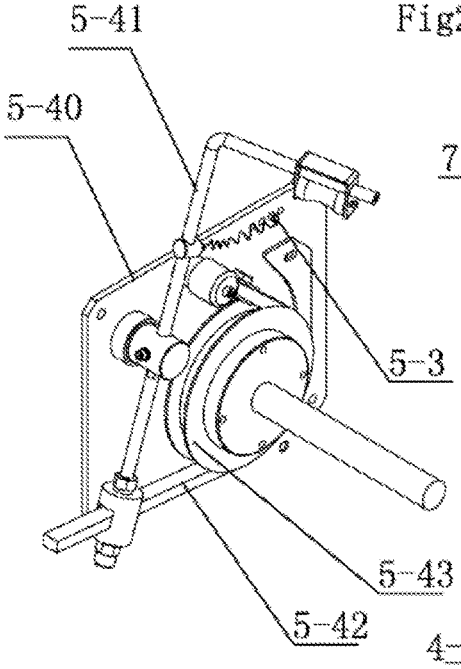
FIG. 21 is a schematic diagram of the structure of the brake mechanism for belt spool packing belts output shown in FIG. 19.
Figure 22:
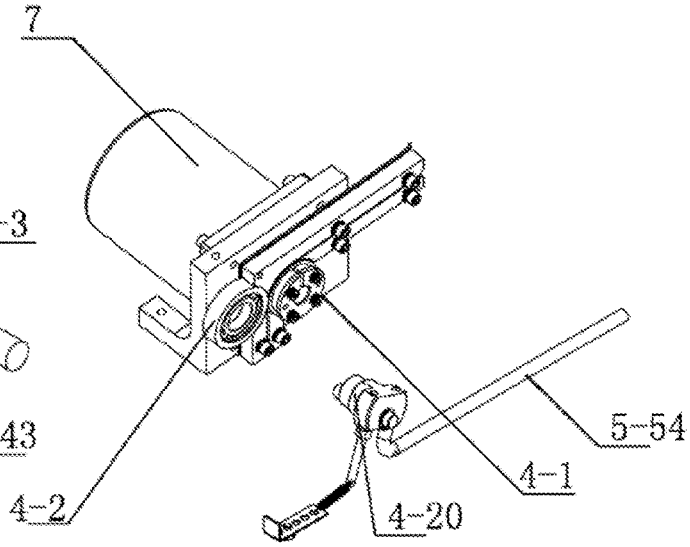
FIG. 22 is a schematic diagram of the belt pre-feeding device shown in FIG. 19 in the present disclosure.
Figure 23:
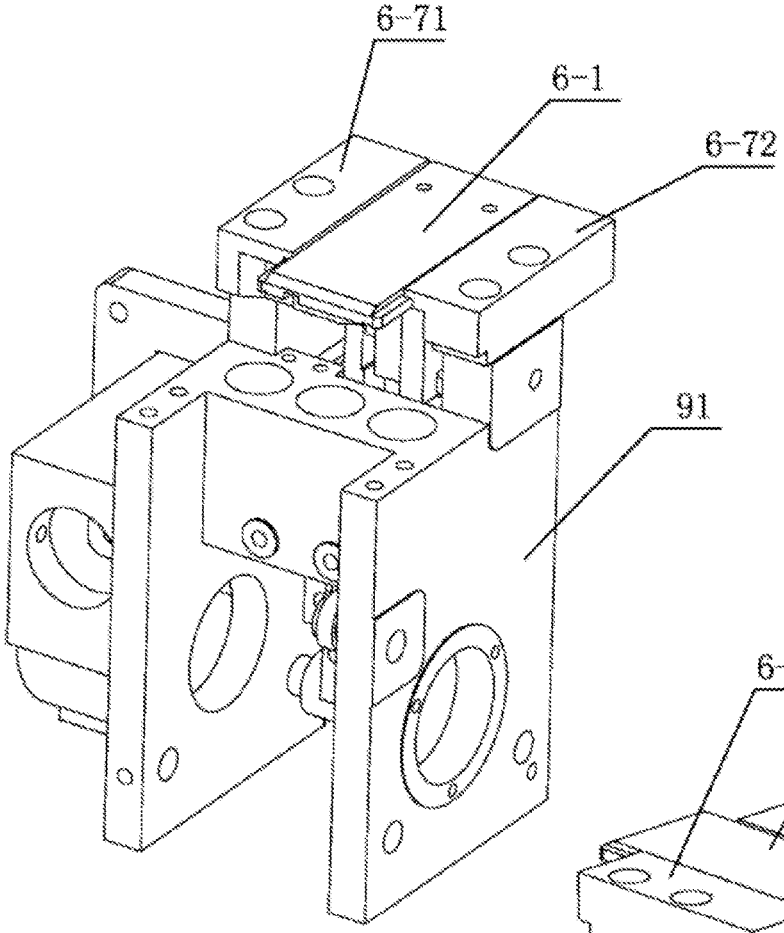
FIG. 23 is a structure diagram related to the hot sticking slide plate mechanism in one embodiment of the packaging machine core in the present disclosure.
Figure 24:
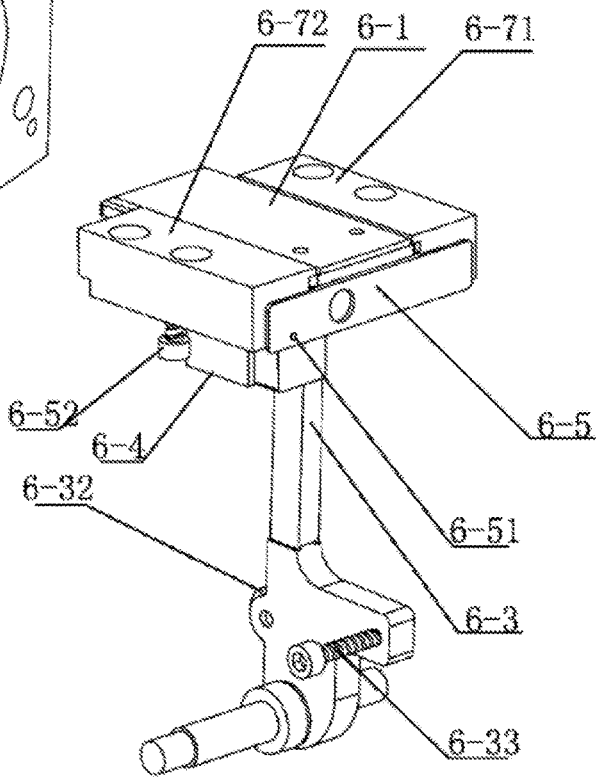
FIG. 24 is a structure diagram of the hot sticking slide plate and its swing arm shown in FIG. 23.
Figure 26:
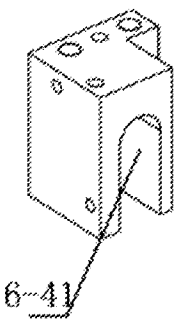
FIG. 26 is a schematic diagram of the bottom slide chair shown in FIG. 24 in the other direction.
Figure 25:
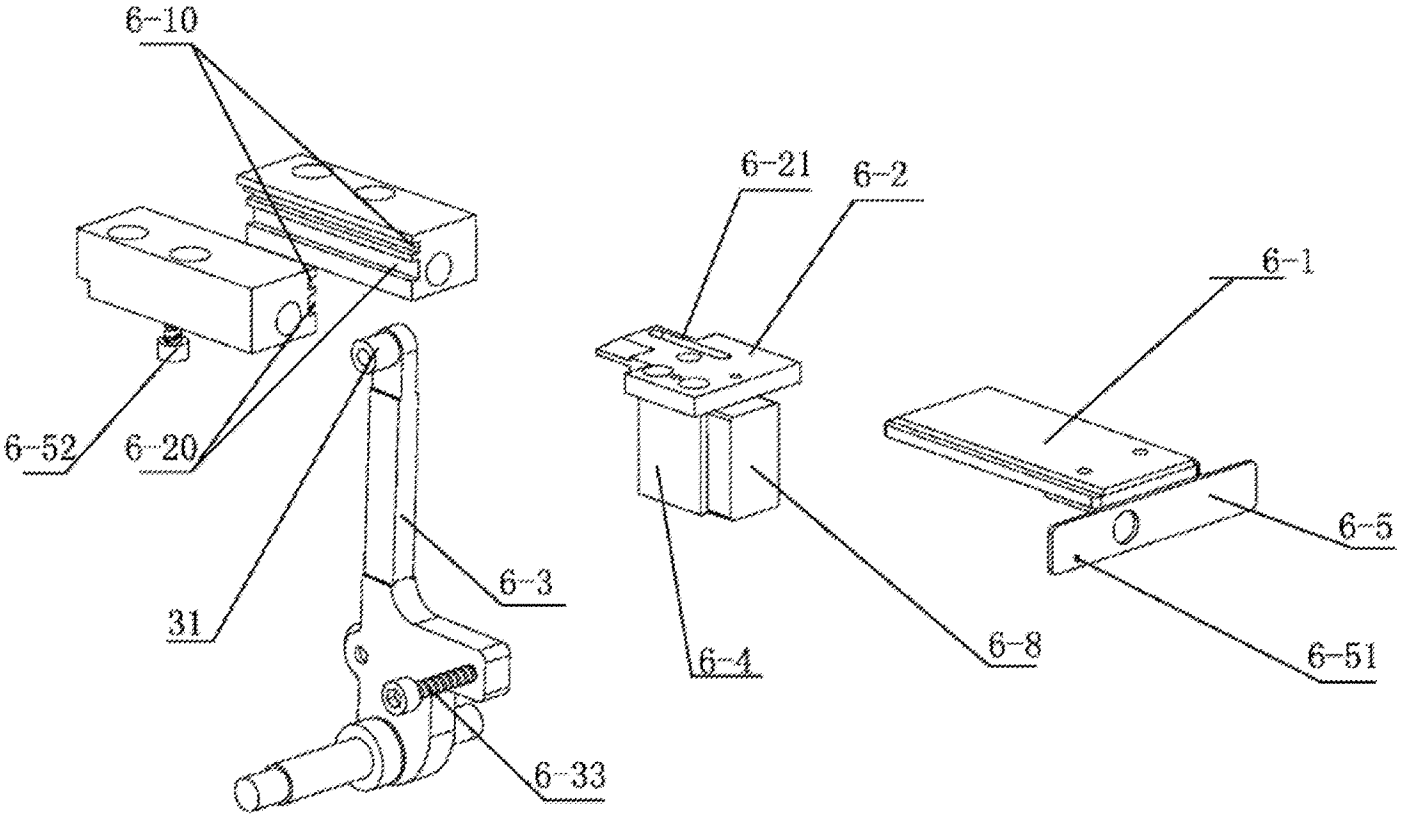
FIG. 25 is an explosive view of the structure shown in FIG. 24.

Refer to FIGS. 17, 18 and 20. The belt pre-feeding device includes a belt pre-feeding drive wheel 4-1, a belt pre-feeding driven wheel 4-2, and a belt pre-feeding drive wheel drive motor 7. The belt pre-feeding drive wheel 4-1, the belt pre-feeding driven wheel 4-2, the belt feeding and retreating drive wheel, the belt feeding and retreating driven wheel, the belt tensioning drive wheel and the belt tensioning driven wheel are positioned at the same side of the vertical mounting plate 1. The drive motor 7 of the belt pre-feeding device, the drive motor 6 of the work process control apparatus and the belt feeding and retreating and belt tensioning drive motor 5 are at the same side of the vertical mounting plate 1.

The packaging machine is provided with a packing belt warehouse 4-10 on the belt feeding path after the belt pre-feeding device. The belt warehouse 4-10 is used for storage of packing belts 8. The belt warehouse 4-10 is positioned before the belt tensioning mechanism. The belt warehouse 4-10 is positioned outside one side of the mounting plate 1 in the packaging machine. A belt warehouse board 4-11 is fixed on the side of the vertical mounting plate 1. The interval between the belt warehouse board 4-11 and the vertical mounting plate 1 is the belt storage space of the belt warehouse. Numeral reference 4-12 in attached drawing stands for the side barrier strip of the belt warehouse.

The belt pre-feeding device is provided with a control device which includes a balance stop lever 4-20 positioned on the bottom of the belt warehouse and used for supporting packing belts in the belt warehouse. The balance stop lever can be swingable. Numeral reference 4-21 in attached drawing stands for the rotation shaft of the balance stop lever installed on the mounting plate 1. The control device is provided with an inductor 4-3 for sensing the amplitude of swing of the balance stop lever. Output signal from the inductor 4-3 is used for controlling operation of the drive motor 7 of the belt pre-feeding device. The control device is also provided with a spring 4-4 which is connected with the balance stop lever 4-20. The moment of force applied by the spring 4-4 to the balance stop lever is opposite to that applied by the packing belt 8 supporting the balance stop lever to the balance stop lever. The spring 4-4 is arranged at the other side of the vertical mounting plate 1 which is separated by the spring and the belt warehouse 4-10. The spring 4-4 is a tension spring. Compared with the method for measuring the quantity of belts stored by a clump weight, the present disclosure adopts tension of an elastic element for detection of belt storage quantity, leading to more sensitive and accurate detection; however, the former method is not very stable for controlling the belt storage quantity.

Numeral reference 4-5 in attached drawing stands for a belt bin gate for the convenience of belt threading on the belt feeding and retreating and belt tensioning device.

When in operation, after threaded manually, the packing belts are conveyed by the belt pre-feeding device to the belt warehouse so that more and more packing belts press on the right end of the balance stop lever to rotate downward. When the packing belts reach a preset weight, the right end of the balance stop lever drops to an inductor (B1) which then outputs signal to shut off the drive motor of the belt pre-feeding device. Conversely, when the belt warehouse is short of packing belts, the right end of the balance stop lever rotates upward and gets out of the induction area of an inductor (B2), the inductor also responds. The motor restarts to work as signal is changed. Direction of arrow c in the Fig. stands for the belt feeding direction.

The structure mentioned above in the present disclosure is quite simple, the control structure is reasonably divided from the belt feeding and retreating and belt tensioning device. The balance stop lever swings with the change of weight of belts stored. The inductor can timely sense the swing status of the balance stop lever and output signal to control operation of the drive motor of the belt pre-feeding device, in this way, the packing belts stored in the belt warehouse are controlled within a reasonable range for the purpose of guaranteeing efficient and reliable operation of the packaging machine.

Refer to FIGS. 19-22. The belt pre-feeding device is provided with a brake mechanism for belt spool packing belts output. Under the action of tension applied by the belt pre-feeding device to the packing belt 8, the brake mechanism acts toward brake release. The belt pre-feeding device is also provided with a return spring 5-3 of the brake mechanism, the return spring 5-3 allows the brake mechanism to act toward braking.

The brake mechanism includes a brake rod 5-41, a brake band 5-42 and a brake disc 5-43 which are articulated and installed on the mounting plate 5-40 of the brake mechanism. One end of the brake band 5-42 is fixedly installed on the mounting plate 5-40 of the brake mechanism. The other end is connected with the brake rod 5-41 via bypassing the brake disc 5-43. One end of the return spring 5-3 is fixedly installed on the mounting plate 5-40 of the brake mechanism, while the other end is connected with the brake rod 5-41. The brake disc 5-43 can also be installed on the mounting plate 5-40.

In addition to on the mounting plate 5-40 of the brake mechanism, the position for fixed installation can also be on an appropriate fixing part near the brake mechanism as long as it is subject to fixed installation. Similarly, the brake rod can be articulated and installed on anything else as long as it is articulated and installed, not necessarily to be articulated and installed on the mounting plate 5-40.

The brake rod is provided with a packing belts guide wheel 5-44. The drawing force applied by the belt pre-feeding device to the packing belts is transferred to the brake mechanism via the packing belts guide wheel 5-44.

The driven wheel 4-2 of belt pre-feeding device is eccentrically connected and installed. The belt pre-feeding device is also provided with an operating rod 5-54 and a return spring 5-58. The operating rod 5-54 is connected with the shaft 4-20 of the driven wheel 4-2 connected with the belt pre-feeding device. The return spring 5-58 is used for restoring the belt pre-feeding device to its normal position after the driven wheel deviates from the drive wheel under the operation of the operating rod.

Numeral reference 5-57 in attached drawing stands for a belt gate through which the packing belts enter the belt pre-feeding device.

On the basis of the structure mentioned above, the present disclosure allows the belt spool to be automatically braked or brake released as the belt pre-feeding device is started or shut off, thus preventing vibration of the belt spool resulted from switchover between starting and shutoff of the belt pre-feeding device.

Refer to FIGS. 23-26. The packaging machine core is internally provided with a hot sticking slide plate mechanism which includes a top slide 6-1, a bottom slide 6-2, a fixed part provided with a sliding chute, and a hot sticking slide plate swing arm 6-3 positioned below the bottom slide. The sliding chute includes a top layer guide slot 6-10 for sliding of the top slide, and a bottom layer guide slot 6-20 for sliding of the bottom slide. The slide plate mechanism is also provided with a bottom slide chair 6-4 on which the bottom slide 6-2 is arranged. The swing arm 6-3 is connected with the bottom slide chair 6-4. The rear of the top slide is connected with a plate 6-5 which leans against the rear end of the bottom slide. The top slide is matched with a left cutter, a middle cutter and a right cutter which are in a cutter mechanism. The hot sticking slide plate swing arm 6-3 can swing at the side in which the packaging machine core is provided with a belt feeding and retreating and belt tensioning drive motor 5.

The fixed part provided with the sliding chute includes a left back-up block 6-71 and a right back-up block 6-72 which are fixed on a packaging machine core rack. The plate 6-5 adopts a connection strap, which is provided with a small hole 6-51. The small hole 6-51 is connected with a tension spring assisting the plate 6-5 to adjoin the bottom slide. The other end of the tension spring is connected with the screw 6-52 on the left back-up block 6-71.

The bottom slide is connected with an induction chip which is installed below an elongated slot 6-21 on the bottom slide. The bottom slide chair is provided with an in-position inductor 6-8. The head of the packing belt impacts the induction chip when belt feeding is in position, and induction signal is produced by the in-position inductor 6-8. The bottom slide chair is provided with a vertical sliding chute 6-41 connected with a swing arm 6-3. The swing arm 6-3 is provided with a sliding shaft 6-31 which is in slip connection with the vertical sliding chute 6-41 of the bottom slide chair 6-4. When in operation, cams controlling hot sticking and cutting installed in the work process control apparatus act on the bearing 6-32 and drive the swing arm 6-3 to swing, thus driving both the top slide and the bottom slide to move. The swing arm 6-3 is connected with a screw 6-33. The screw 6-33 is used for connecting with a large tension spring. The other end of the large tension spring is connected to the packaging machine core rack.

In the above-mentioned structure, the hot sticking slide plate consists of the top slide and the bottom slide, both of which perform their own functions and combine mutually, thus improving the operation quality and prolonging the service life of the hot sticking slide plate. Furthermore, the top slide and the bottom slide are respectively subject to guiding slide. Both the top slide and the bottom slide are not easy to wear due to no friction force produced, therefore they are long in service life and convenient for disassembling.

Figure 27:
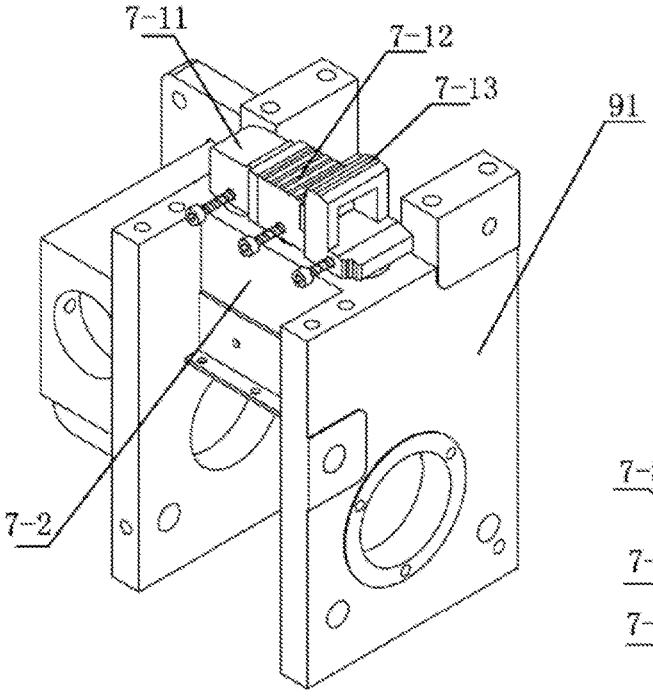
FIG. 27 is a structure diagram related to the belt cutter mechanism in one embodiment of the packaging machine core.
Figure 29:
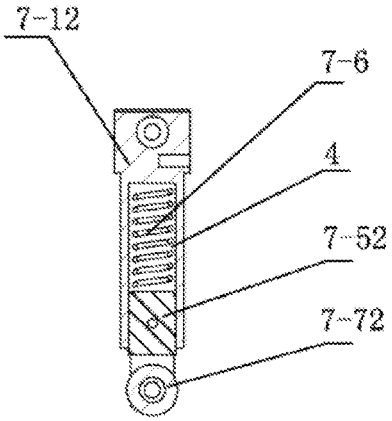
FIG. 29 is a section view regarding to the combination state of the middle cutter and the middle cutter guide pillar in the mode of execution shown in FIG. 27
Figure 28:
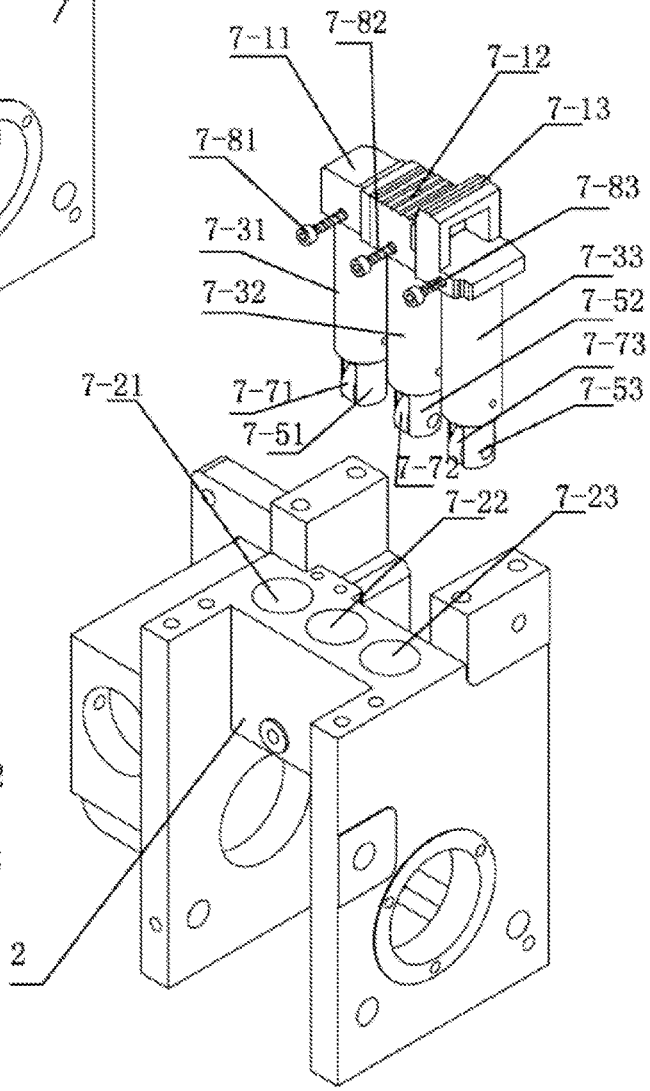
FIG. 28 is an explosive view of the structure shown in FIG. 27.

Refer to FIGS. 27-29. The packaging machine core is internally provided with a cutter mechanism which includes a left cutter 7-11, a middle cutter 7-12 and a right cutter 7-13. The belt cutter mechanism is also provided with a guide part 7-2 arranged on the packaging machine core rack. The guide part constitutes a part of the packaging machine core rack. The guide part is internally provided with a vertical lifting guide hole 7-21 for the left cutter, a vertical lifting guide hole 7-22 for the middle cutter, and a vertical lifting guide hole 7-23 for the right cutter. The belt cutter mechanism is also provided with a left cutter guide pillar 7-31, a middle cutter guide pillar 7-32, and a right cutter guide pillar 7-33. The left cutter guide pillar 7-31, the middle cutter guide pillar 7-32 and the right cutter guide pillar 7-33 are respectively positioned in and slidingly and guidingly matched with the lifting guide hole 7-21 for the left cutter, the lifting guide hole 7-22 for the middle cutter and the lifting guide hole 7-23 for the right cutter. The left cutter 7-11, the middle cutter 7-12 and the right cutter 7-13 are respectively arranged on the top of the left cutter guide pillar 7-31, the middle cutter guide pillar 7-32 and the right cutter guide pillar 7-33.

The left cutter guide pillar, the middle cutter guide pillar and the right cutter guide pillar are respectively provided with a mounting hole open downward. Taking the middle cutter guide pillar as an example, Numeral reference 7-4 in attached drawing stands for a mounting hole in the middle cutter guide pillar, the left cutter guide pillar and the right cutter guide pillar have similar structures.

The left cutter guide pillar, the middle cutter guide pillar and the right cutter guide pillar are respectively mounted on a lifting drive plunger 7-51 of the left cutter guide pillar, a lifting drive plunger 7-52 of the middle cutter guide pillar, and a lifting drive plunger 7-53 of the right cutter guide pillar. The lifting drive plunger is inserted into the mounting hole. Between the lifting drive plunger and the mounting hole is provided with a pressure spring. Taking the middle cutter guide pillar as an example, numeral reference 7-6 in attached drawing stands for a pressure spring, the left cutter guide pillar and the right cutter guide pillar have similar structures.

Lifting drive plungers 7-51, 7-52 and 7-53 are respectively provided with bearings 7-71, 7-72 and 7-73. Relying on motion of cams for hot sticking and belt cutting installed in the work process control apparatus, the bearings drive the left cutter, the middle cutter and the right cutter to move up and down.

The left cutter, the middle cutter and the right cutter are respectively provided with a connection screw 7-81, a connection screw 7-82 and a connection screw 7-83 which are used for connecting with tension spring for operation and restoration.

The process of operation of the belt cutter mechanism is described below. The right cutter jacks up, the bottom slide retreats. Meanwhile, the left cutter jacks up. The hot sticking head reaches the center of two packing belts. The middle cutter jacks up and cuts off the packing belts and then descends. The hot sticking head retreats. The middle cutter jacks up for sticking the belts. Both the left cutter and the middle cutter descend. The top slide retreats and articles are strapped by the packing belts.

In the above-mentioned structure, positions of the left cutter, the middle cutter and the right cutter are defined respectively by the lifting guide hole for the left cutter, the lifting guide hole for the middle cutter, and the lifting guide hole for the right cutter. After installation it is unnecessary to adjust positions of the left cutter, the middle cutter and the right cutter. Therefore, lifting motion of the left cutter, the middle cutter and the right cutter is stable and accurate, with good repeatability.

Figure 30:
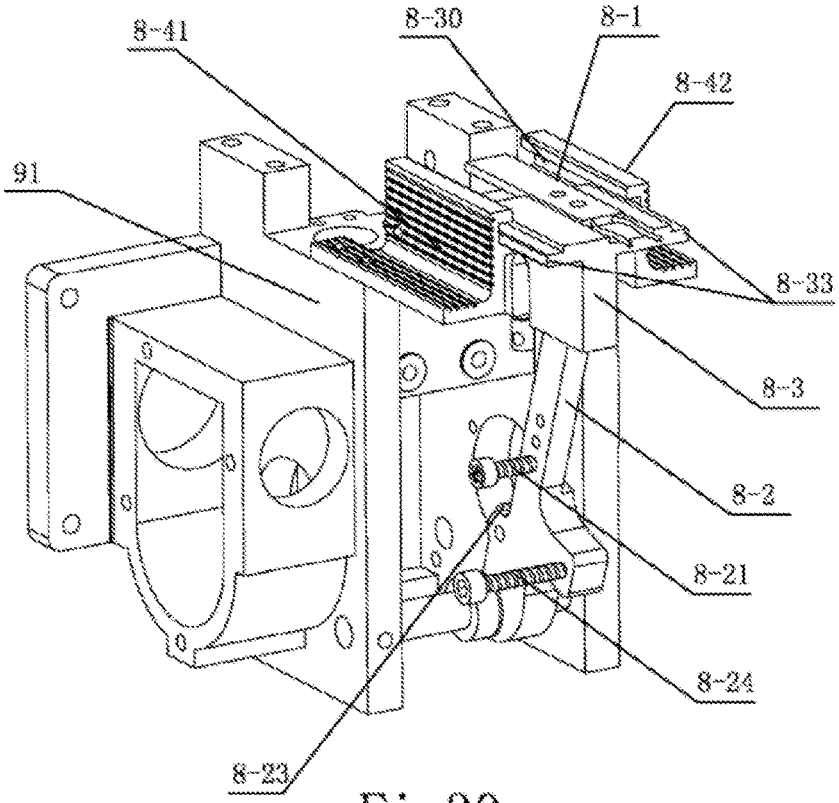
FIG. 30 is a structure diagram related to the hot sticking mechanism in one embodiment of the packaging machine core.
Figure 31:
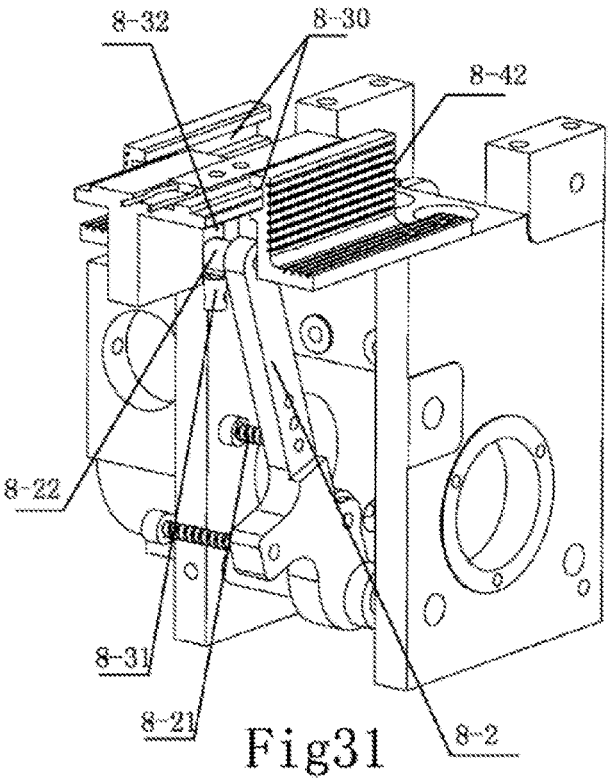
FIG. 31 is a schematic diagram of the structure shown in FIG. 30 in the other direction.

Refer to FIGS. 30 and 31. The packaging machine core is internally provided with a hot sticking mechanism which includes a hot sticking head 8-1, and a swing arm 8-2 below the hot sticking head. The hot sticking mechanism is also provided with a hot sticking head seat 8-3 slidable along the direction perpendicular to packing belts for hot sticking. The hot sticking head 8-1 is mounted on the top of the hot sticking head seat 8-3. The hot sticking mechanism is also provided with a guide mechanism for sliding of the hot sticking head seat. The swing arm 8-2 is connected with the hot sticking head seat 8-3. The swing arm 8-2, the first wrench rod 1-31 and the second wrench rod 2-31 are at the same side of the packaging machine core.

The hot sticking head seat 8-3 is provided with a pin 8-31. A small tension spring is connected between the pin 8-31 and the screw 8-21 on the swing arm 8-2, assisting operation and restoration of the hot sticking head and the hot sticking head seat.

The guide mechanism includes a left back-up block 8-41 and a right back-up block 8-42 which are fixed on the packaging machine core rack. The left back-up block 8-41 and the right back-up block 8-42 are respectively provided with a guide slot 30 for sliding of the hot sticking head seat 8-3. Both sides of the hot sticking head seat 8-3 are provided with a side track 8-33 slidingly matched with the guide slot 8-30.

The hot sticking head seat is provided with a vertical sliding chute 8-32 connected with the swing arm 8-2. The swing arm 8-2 is provided with a unit in slip connection with the vertical sliding chute 8-32.

The unit adopts a shaft 8-22.

Hot sticking relies on rotation of the cams for hot sticking and belt cutting installed in the work process control apparatus. Different pivots of the cams act on the bearing 8-23 installed on the swing arm 8-2 so that the swing arm 8-2 swings.

The swing arm 8-2 is provided with a screw 8-24 for connecting with the large tension spring. The other end of the large tension spring is connected to the packaging machine core rack. In the above-mentioned structure, the hot sticking head of the packaging machine conducts a rectilinear motion, stably and accurately, thus improving the hot sticking quality of packing belts.

Figure 32:
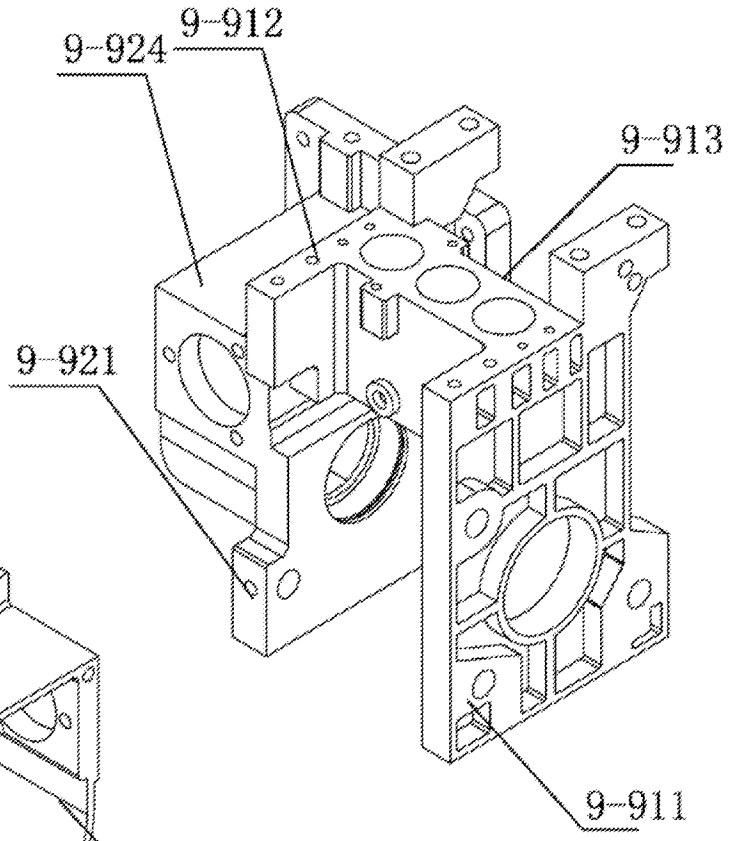
FIG. 32 is an assembly schematic diagram of the first rack and the second rack in the packaging machine core rack.
Figure 33:
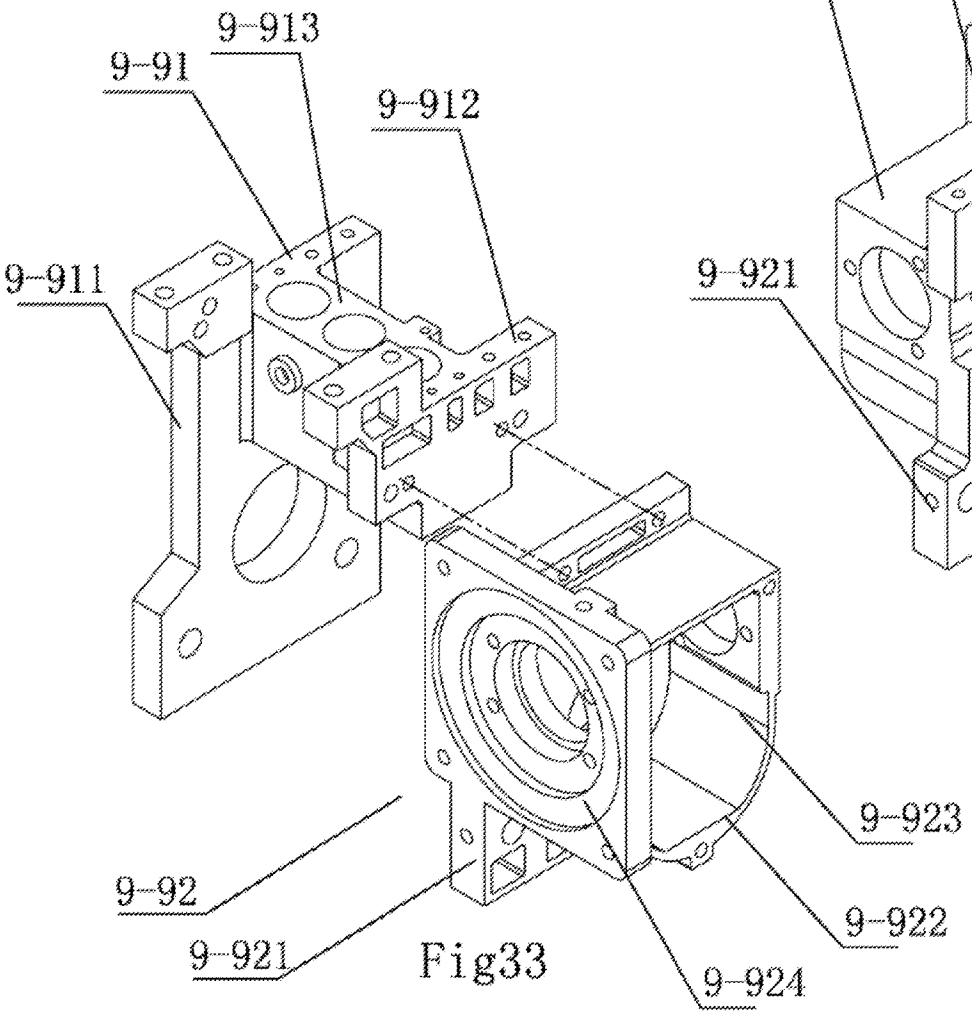
FIG. 33 is an explosive view of FIG. 32.

Refer to FIGS. 32 and 33. The packaging machine core is internally provided with a packaging machine core rack which is divided into three separate parts: a first rack 9-91, a second rack 9-92 and a third rack 9-93. The first rack 9-91 is positioned in the middle, used for installing the packaging machine and related to hot sticking and belt cutting;

The second rack 9-92 is used for installing the drive motor 6 and the reducing mechanism 9-69 of the work process control apparatus. The third rack 9-93 is used for installing the belt feeding and retreating and belt tensioning device. The packaging machine core rack is mounted on the horizontal mounting plate 9. The first rack 9-91 is positioned in the middle, the second rack 9-92 and the third rack 9-93 are respectively positioned at both sides of the first rack 9-91. Mechanisms related to hot sticking and belt cutting include the hot sticking mechanism, the hot sticking slide plate mechanism, and the belt cutter mechanism. The hot sticking mechanism includes a hot sticking head and a swing mechanism thereof. The hot sticking slide plate mechanism includes a hot sticking slide plate and a swing mechanism thereof. The belt cutter mechanism includes a left cutter, a middle cutter, a right cutter, and their respective lifting mechanisms.

The side at which the first rack 9-91 is close to the third rack 9-93 is provided with a first wallboard 9-911. The side at which the first rack 9-91 is close to the second rack 9-92 is provided with a connecting plate 9-912. Between the first wallboard 9-911 and the connecting plate 9-912 is connected with a beam 9-913.

The side at which the second rack 9-92 is close to the first rack 9-91 is provided with a second wallboard 921. The second wallboard 921 is connected with the connecting plate 912 by bolts. The side (of the second rack 9-92) at which the second wallboard 921 deviates from the first rack is provided with a bedplate 9-922 for installing the drive motor 6 and the reducing mechanism of the work process control apparatus. The bedplate 9-922 includes a bedplate inner chamber 9-923. Bedplate inner chamber 9-923 is used for setting the reducing mechanism 9-69. The outer wall of the bedplate inner chamber 9-923 is provided with an installation interface 9-924 for installing the drive motor 6 of the work process control apparatus.

In the above-mentioned structure, both the packaging machine core and rack thereof are divided reasonably, which allows that both the first rack and the second rack can be manufactured by pressure casting, characterized by denser materials formed, higher strength, more beautiful appearance, and more convenient for intensity and commissioning than former machine cores and racks.

What is claimed is:

1. A packaging machine, comprising:

a packaging machine frame;

a vertical mounting plate;

a horizontal mounting plate fixed at an upper part of the vertical mounting plate, wherein the horizontal mounting plate includes a fixed frame that encloses an article binding workstation from a plurality of directions, and wherein the vertical mounting plate and the fixed frame are mounted on the packaging machine frame;

a belt spool;

a packaging machine core having a belt feeding and retreating and belt tensioning device, wherein the belt feeding and retreating and belt tensioning device comprises a belt feeding and retreating mechanism and a belt tensioning mechanism; and a belt pre-feeding device, wherein the belt spool, the packaging machine core and the belt pre-feeding device are mounted on the horizontal mounting plate, wherein the belt feeding and retreating mechanism comprises a belt feeding and retreating drive wheel and a belt feeding and retreating driven wheel, wherein the belt feeding and retreating driven wheel is sleeved on a belt feeding and retreating driven wheel axle, wherein the belt feeding and retreating driven wheel axle is driven by a first eccentric mechanism, wherein the belt feeding and retreating mechanism also comprises a first wrench rod and a swing drive mechanism of the first wrench rod, wherein, when driven by the first wrench rod, the first eccentric mechanism rotates, wherein the swing drive mechanism of the first wrench rod moves under control of a first cam, wherein the swing drive mechanism of the first wrench rod is provided with an insert position for insertion of the first wrench rod, wherein, after inserting into the insert position, the first wrench rod, driven by a device constituting the insert position, swings up and down, wherein the insert position comprises a plurality of pins arranged above and below the first wrench rod, respectively, wherein the belt tensioning mechanism comprises a belt tensioning drive wheel and a belt tensioning driven wheel, wherein the belt tensioning driven wheel is sleeved on a belt tensioning driven wheel axle, wherein the belt tensioning driven wheel axle is driven by a second eccentric mechanism, wherein the belt tensioning mechanism also comprises a second wrench rod and a swing drive mechanism of the second wrench rod, wherein, when driven by the second wrench rod, the second eccentric mechanism rotates, wherein the swing drive mechanism of the second wrench rod moves under control of a second cam, wherein the swing drive mechanism of the second wrench rod comprises a connecting rod and a second swing rod arranged vertically, wherein the second swing rod is connected with a first knuckle bearing which is sleeved on the connecting rod, wherein the second wrench rod is connected to a second knuckle bearing which is sleeved and supported on the connecting rod, wherein the second knuckle bearing is positioned under the first knuckle bearing, wherein one end of the connecting rod is in threaded connection with an adjusting nut, wherein the first knuckle bearing is provided with a first pressure spring, wherein a second pressure spring is provided between the first knuckle bearing and the second knuckle bearing, wherein both the first pressure spring and the second pressure spring are sleeved outside the connecting rod, wherein a first swing rod is provided with a rolling element matched with the first cam, wherein the belt feeding and retreating drive wheel and the belt tensioning drive wheel are driven by a belt feeding and retreating and belt tensioning drive motor, wherein the first wrench rod, the second wrench rod and the belt feeding and retreating and belt tensioning drive motor are positioned on a first side of the packaging machine core, wherein the belt feeding and retreating drive wheel, the belt feeding and retreating driven wheel, the belt tensioning drive wheel and the belt tensioning driven wheel are positioned on a second side of the packaging machine core opposite the first side of the packaging machine core, wherein the packaging machine core is internally provided with a hot sticking slide plate mechanism which includes a top slide, a bottom slide, a fixed part provided with a sliding chute, and a hot sticking slide plate swing arm positioned below the bottom slide, wherein the sliding chute includes a top layer guide slot for sliding of the top slide, and a bottom layer guide slot for sliding of the bottom slide, wherein the fixed part provided with the sliding chute includes a left back-up block and a right back-up block which are fixed on a packaging machine core rack, wherein the slide plate mechanism is also provided with a bottom slide chair on which the bottom slide is arranged, wherein the bottom slide chair is provided with a vertical sliding chute connected with the hot sticking slide plate swing arm, wherein the rear of the top slide is connected with a plate which leans against the rear-end of the bottom slide, wherein the plate which leans against the rear-end of the bottom slide is connected with a tension spring which aids the plate to adjoin the bottom slide, wherein the top slide is matched with a left clamp, a middle cutter and a right clamp which are in a cutter mechanism, wherein the hot sticking slide plate swing arm can swing at the side in which the packaging machine core is provided with a belt feeding and retreating and belt tensioning drive motor;

wherein the packaging machine core is internally provided with the cutter mechanism which includes the left clamp, the middle cutter and the right clamp, wherein the belt cutter mechanism is also provided with a guide part arranged on the packaging machine core rack, wherein the guide part is internally provided with a vertical lifting guide hole for the left clamp, a vertical lifting guide hole for the middle cutter, and a vertical lifting guide hole for the right clamp, wherein the belt cutter mechanism is also provided with a left cutter guide pillar, a middle cutter guide pillar, and a right cutter guide pillar, wherein the left cutter guide pillar, the middle cutter guide pillar and the right cutter guide pillar are respectively positioned in and slidingly and guidingly matched with the lifting guide hole for the left clamp, the lifting guide hole for the middle cutter and the lifting guide hole for the right clamp, wherein the left clamp, the middle cutter and the right clamp are respectively arranged on the top of the left cutter guide pillar, the middle cutter guide pillar and the right cutter guide pillar, wherein the left cutter guide pillar, the middle cutter guide pillar and the right cutter guide pillar are respectively provided with a mounting hole open downward, wherein the left cutter guide pillar, the middle cutter guide pillar and the right cutter guide pillar are respectively mounted on a lifting drive plunger which is inserted into the mounting hole, wherein between the lifting drive plunger and the mounting hole is provided with a pressure spring; the guide part is a part of the packaging machine core rack, wherein the packaging machine core is internally provided with a hot sticking mechanism which includes a hot sticking head, and a hot sticking head swing arm below the hot sticking head, wherein the hot sticking mechanism is also provided with a hot sticking head seat slidable along the direction perpendicular to packing belts for hot sticking, wherein the hot sticking head is mounted on the top of the hot sticking head seat; the hot sticking mechanism is also provided with a guide mechanism for sliding of the hot sticking head seat, wherein the hot sticking head swing arm is connected with the hot sticking head seat, wherein the hot sticking head seat is provided with a vertical sliding chute connected with the hot sticking head swing arm, wherein the hot sticking head swing arm is provided with a protrusion in slip connection with the vertical sliding chute, wherein the guide mechanism includes a second left back-up block and a second right back-up block which are fixed on the packaging machine core rack, wherein the second left back-up block and the second right back-up block are respectively provided with a guide slot for sliding of the hot sticking head seat, wherein both sides of the hot sticking head seat are provided with a side track slidingly matched with the guide slot, wherein between the lower end of the hot sticking head seat and the hot sticking head swing arm is connected with a tension spring, and wherein the hot sticking head swing arm, the first wrench rod and the second wrench rod are at the same side of the packaging machine core.

2. The packaging machine of claim 1, wherein the fixed frame is provided with a packing belt track which encloses an article binding workstation from left, right and above, wherein an inner side of the fixed frame is provided with a packing belt outlet along the packing belt track, wherein the fixed frame is internally provided with a fixed track wall outboard and a movable track wall inboard which comprises a plurality of rotatable single blades, wherein a packing belt carrying track is formed between the fixed track wall and the movable track wall, wherein, on a basis of feed direction of packing belts, an upstream end of each single blade downstream laps outside of a downstream end of a respective adjacent single blade upstream, and wherein the rotatable single blades are provided with a return spring which enables the single blades to restore and reconstitute the movable track wall after being opened by packing belts.

3. The packaging machine of claim 1, wherein the first eccentric mechanism includes a first connecting plate and a first eccentric shaft, wherein the belt feeding and retreating driven wheel axle and the first eccentric shaft are positioned on the two sides of the first connecting plate, wherein the belt feeding and retreating driven wheel axle is parallel to the first eccentric shaft, but not on a same axis, wherein the first wrench rod is connected with the first eccentric shaft;

wherein the second eccentric mechanism includes a second connecting plate and a second eccentric shaft, wherein the belt tensioning driven wheel axle and the second eccentric shaft are positioned on two sides of the second connecting plate, wherein the belt tensioning driven wheel axle is parallel to the second eccentric shaft but not on a same axis; the second wrench rod is connected with the second eccentric shaft;

wherein the swing drive mechanism of the first wrench rod includes a first lifting rod and the first swing rod, wherein the lower end of the first lifting rod is articulated with the first swing rod, wherein the insert position is located on a block installed on the first lifting rod, wherein the first swing rod is provided with a rolling element matched with a cam controlling the swing drive mechanism of the first wrench rod; and wherein both the first wrench rod and the first swing rod are respectively connected with a return spring.

4. The packaging machine of claim 1, wherein the belt feeding and retreating and belt tensioning drive motor is provided with a reduction gear set, wherein the belt tensioning drive wheel is arranged on the reduction output shaft of the reduction gear set, wherein the input end gear of the reduction gear set is arranged on the power-output shaft of the motor, wherein the motor is also provided with a belt drive mechanism, wherein the drive wheel of the belt drive mechanism is arranged on the power-output shaft of the motor, and wherein the belt feeding and retreating drive wheel is connected with the driven wheel of the belt drive mechanism.

5. The packaging machine of claim 2, wherein an installation side of each of the movable single blades is flexed and forms the bottom of packing belt track;

wherein each of the movable single blades is connected to a hinge, wherein the return spring thereof is arranged in the hinge, wherein the hinge is installed on the fixed frame or the fixed track wall;

wherein the fixed track wall is fixedly connected to the fixed frame;

wherein the fixed frame comprises a frame body and a frame cover plate connected to each other, wherein a lower part of the fixed frame is provided with a lower left packing belt track and a lower right packing belt track which are fixedly installed, and wherein both the lower left packing belt track and the lower right packing belt track gradually become narrow along the belt moving direction downstream.

6. The packaging machine of claim 1, further comprising a packaging machine core work process control apparatus which includes a rotatable main shaft, wherein the main shaft is connected via a reducing mechanism to a drive motor, wherein the drive motor and the belt feeding and retreating and belt tensioning drive motor are positioned at a same side of the packaging machine core, wherein the main shaft is provided with a plurality of cams pivoting on the main shaft, wherein the cams include a plurality of cams controlling hot sticking and cutting, cams controlling the swing drive mechanism of the first wrench rod, and cams controlling the swing drive mechanism of the second wrench rod, wherein the work process control apparatus is also provided with a first inductor and a second inductor along an axial direction of the main shaft, wherein an output signal from both the inductors is used for controlling operation of motors in the belt feeding and retreating and belt tensioning device as well as the drive motor, wherein the main shaft is also provided with two turnplates pivoting on the main shaft, wherein each of the turnplates is provided with a baffle matched with the corresponding inductor;

wherein both the cams and the turnplates in the work process control apparatus are arranged at both sides of the connecting location between the main shaft and the reducing mechanism, wherein the reducing mechanism is a turbine worm or a reduction gear set;

wherein one of the two turnplates is provided with a first baffle and a second baffle which are matched with the first inductor, wherein the starting baffle signal from the first baffle and the first inductor is used for rotation of the belt feeding and retreating and belt tensioning drive motor toward belt retreating direction, wherein an operation of the packaging machine is also provided with a plurality of time relays and a first shutoff opportunity for rotation of the belt feeding and retreating and belt tensioning drive motor toward belt retreating direction under the control of the time relays, wherein the drive motor of the work process control apparatus has a second shutoff opportunity after the first shutoff opportunity, wherein the second shutoff opportunity is controlled by the time relays, wherein the drive motor of the work process control apparatus has a third startup opportunity after the second shutoff opportunity, wherein the third startup opportunity is controlled by the time relays, wherein a stand-by time between the second shutoff opportunity and the third startup opportunity of the drive motor of the work process control apparatus is used for hot sticking by the packaging machine core, wherein the second baffle is matched with the first inductor after the third startup opportunity, wherein the starting baffle signal sent from the second baffle to the first inductor is used for rotation of the belt feeding and retreating and belt tensioning drive motor toward belt feeding direction, wherein the rotation time of the belt feeding and retreating and belt tensioning drive motor toward belt feeding direction is controlled by the time relays and an in-position inductor, wherein the other one of the two turnplates is provided with a third baffle, wherein the third baffle is matched with the second inductor after ceasing rotation of the belt feeding and retreating and belt tensioning drive motor toward belt feeding direction, and wherein the output signal from the second inductor is used for controlling flyback action of the drive motor of the work process control apparatus for a next cyclic operation.

7. The packaging machine of claim 1, wherein the belt pre-feeding device includes a belt pre-feeding drive wheel, a belt pre-feeding driven wheel, and a belt pre-feeding drive wheel drive motor, wherein the belt pre-feeding drive wheel, the belt pre-feeding driven wheel, the belt feeding and retreating drive wheel, the belt feeding and retreating driven wheel, the belt tensioning drive wheel and the belt tensioning driven wheel are positioned at a same side of the vertical mounting plate, wherein the drive motor of the belt pre-feeding device, the drive motor of the work process control apparatus and the belt feeding and retreating and belt tensioning drive motor are at a same side of the vertical mounting plate;

wherein the packaging machine further comprises a packing belt warehouse on the belt feeding path after the belt pre-feeding device, wherein the belt warehouse is used for storage of packing belts, wherein the belt pre-feeding device is provided with a control device which includes a balance stop lever positioned on the bottom of the belt warehouse and used for supporting packing belts in the belt warehouse, wherein the balance stop lever is swingable, wherein the control device is provided with an inductor for sensing the amplitude of swing of the balance stop lever, wherein an output signal from the inductor is used for controlling operation of the drive motor of the belt pre-feeding device, wherein the control device is also provided with a spring which is connected with the balance stop lever, wherein the moment of force applied by the spring to the balance stop lever is opposite to that applied by the packing belt supporting the balance stop lever to the balance stop lever, wherein the spring is arranged at the other side of the vertical mounting plate which is separated by the spring and the belt warehouse, and wherein the spring is a tension spring.

8. The packaging machine of claim 7, wherein the belt pre-feeding device is also provided with a brake mechanism for belt spool packing belts output, wherein under an action of drawing force applied by the belt pre-feeding device to the packing belts, the brake mechanism acts toward the direction of brake relief, wherein the belt pre-feeding mechanism is also provided with a return spring of the brake mechanism, wherein the return spring enables the brake mechanism to act toward the direction of braking, wherein the brake mechanism includes a brake rod, a brake band and a brake disc which are articulated, wherein one end of the brake band is installed fixedly and the other end is connected with the brake rod via bypassing the brake disc, wherein one end of the return spring is installed fixedly while the other end is connected with the brake rod, wherein the brake rod is provided with a packing belts guide wheel, wherein the drawing force applied by the belt pre-feeding device to the packing belts is transferred to the brake mechanism via the packing belts guide wheel, wherein the belt pre-feeding device is also provided with an operating rod and a return spring, wherein the operating rod is connected with the driven wheel, and wherein the return spring is used for restoring the belt pre-feeding device to its normal position after the driven wheel deviates from the drive wheel under the operation of the operating rod.

9. The packaging machine of claim 1, wherein the packaging machine core is internally provided with a packaging machine core rack which is divided into three separate parts including a first rack, second rack and a third rack, wherein the first rack is positioned in the middle and used for installing the packaging machine and related to hot sticking and belt cutting, wherein the second rack is used for installing the drive motor and the reducing mechanism of the work process control apparatus, wherein the third rack is used for installing the belt feeding and retreating and belt tensioning device, wherein the packaging machine core rack is mounted on the horizontal mounting plate, wherein the second rack and the third rack are respectively positioned at both sides of the first rack, wherein the side at which the first rack is close to the third rack is provided with a first wallboard, wherein the side at which the first rack is close to the second rack is provided with a connecting plate, wherein a beam is connected between the first wallboard and the connecting plate;

wherein the side at which the second rack is close to the first rack is provided with a second wallboard which is connected with the connecting plate by bolts, wherein the side of the second rack at which the second wallboard deviates from the first rack is provided with a bedplate for installing the drive motor and the reducing mechanism of the work process control apparatus, wherein the bedplate includes a bedplate inner chamber which is used for setting the reducing mechanism, and wherein the outer wall of the bedplate inner chamber is provided with an installation interface for installing the drive motor of the work process control apparatus.

* * * * *